US007210317B2

(12) United States Patent
Beane et al.

(10) Patent No.: US 7,210,317 B2
(45) Date of Patent: May 1, 2007

(54) CONTROLLABLY EXTENDIBLE RESTRAINT INTERCONNECTIONS

(76) Inventors: Shawn F. Beane, 1225 Rose Ct., Bartlett, IL (US) 60103; Thomas P. Chesters, 1901 Marigold La., Hanover Park, IL (US) 60133

( * ) Notice: Subject to any disclaimer, the term of this patent is extended or adjusted under 35 U.S.C. 154(b) by 152 days.

(21) Appl. No.: 10/407,106

(22) Filed: Apr. 5, 2003

(65) Prior Publication Data

US 2005/0193782 A1 Sep. 8, 2005

(51) Int. Cl.
*E05B 75/00* (2006.01)

(52) U.S. Cl. ..... 70/16; 128/878; 128/879

(58) Field of Classification Search ..... 70/14–18; 128/878, 879, 869; 482/116; 119/770, 792, 119/794, 796, 818, 819
See application file for complete search history.

(56) References Cited

U.S. PATENT DOCUMENTS

| | | | | |
|---|---|---|---|---|
| 1,534,936 | A | 4/1925 | Fischbach | |
| 3,088,438 | A * | 5/1963 | Oliphant | 119/770 |
| 3,693,596 | A * | 9/1972 | Croce et al. | 119/796 |
| 3,937,418 | A * | 2/1976 | Critelli | 242/384.7 |
| 3,964,441 | A * | 6/1976 | Wall | 119/796 |
| 3,991,444 | A | 11/1976 | Bailey | |
| 4,024,736 | A | 5/1977 | De Michieli | |
| 4,231,535 | A | 11/1980 | Schlegel et al. | |
| 4,621,589 | A * | 11/1986 | Thinnes | 119/770 |
| 5,138,852 | A * | 8/1992 | Corcoran | 70/16 |
| 5,343,562 | A * | 9/1994 | Bible | 2/16 |
| 5,377,626 | A | 1/1995 | Kilsby et al. | |
| 5,380,066 | A | 1/1995 | Wiseman et al. | |
| 5,497,732 | A * | 3/1996 | Moffre et al. | 119/784 |
| 5,551,447 | A * | 9/1996 | Hoffman et al. | 128/869 |
| 5,638,772 | A * | 6/1997 | Kaufmann et al. | 119/770 |
| 5,687,593 | A | 11/1997 | Cross | |
| 5,768,920 | A | 6/1998 | DeBevoise | |
| 6,017,173 | A | 1/2000 | Anthony et al. | |
| 6,026,661 | A | 2/2000 | Spiropoulos | |
| 6,368,262 | B1 * | 4/2002 | Willoughby et al. | 482/148 |
| 6,912,975 | B1 * | 7/2005 | Balan | 119/794 |

FOREIGN PATENT DOCUMENTS

JP 62153808 A2 7/1987

OTHER PUBLICATIONS

Aramark Co.; Gall's Law Enforcement 2003 Buyers Guide; Cover plus pp. 56, 57, 59; Jan. 2003; USA.
Yossie; Yossie's Hancuff Collection; from Internet site www.blacksteel.com/hcs/.
Joseph W. Lauher; Collector's Guide to Vintage Handcuffs; from Internet site www.handcuffs.org.

* cited by examiner

*Primary Examiner*—Lloyd A. Gall

(57) ABSTRACT

The apparatus of the present invention typically comprises a pair of opposing restraint members wherein a first restraint member is attached to a first end of a thin, flexible, high tensile belt, cord or cable tether, whose second end is attached to a controllably-ratcheted, winding-rewinding spool within a suitable housing. A second restraint member is attached to an opposite end of the housing. The housing may have respective arms which further include a pivotable connection. When actuated by a user, a controllable ratchet-pawl release mechanism permits the tether to be withdrawn against the tension of the rewinding mechanism. When the ratchet-pawl release mechanism ceases to be actuated, the tether can no longer be extracted and can only be ratcheted back onto the spool while being retracted by the rewinding mechanism, thus bringing the attached opposing restraint members toward a closed connection.

10 Claims, 9 Drawing Sheets

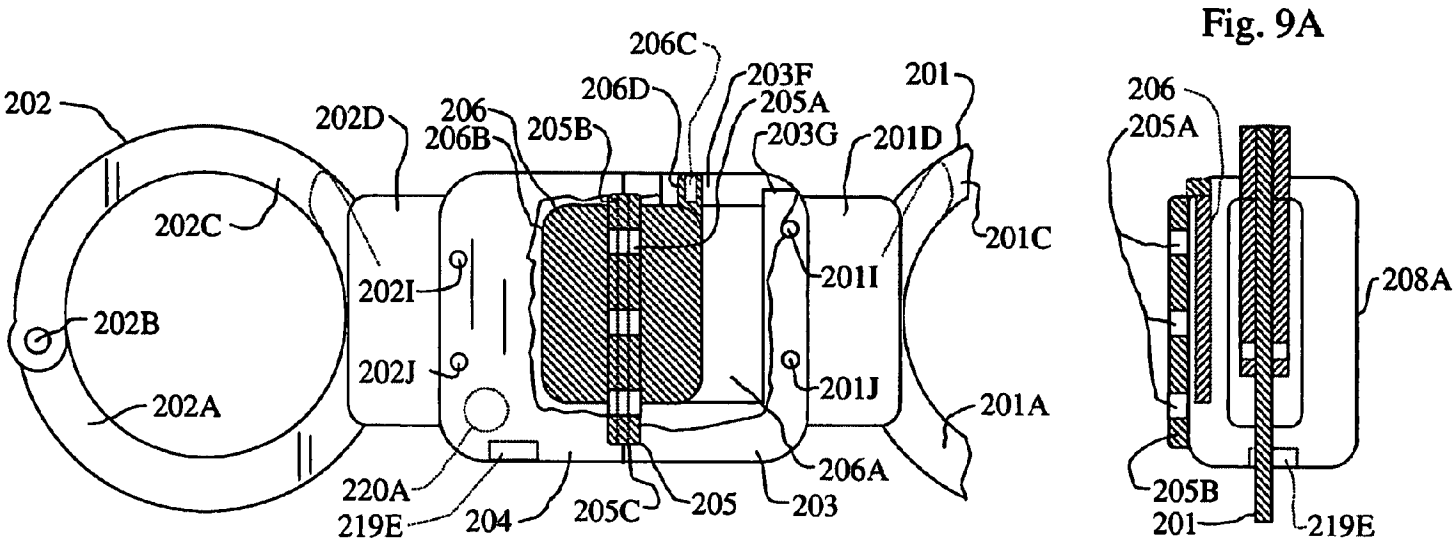
Fig. 9A
Fig. 9
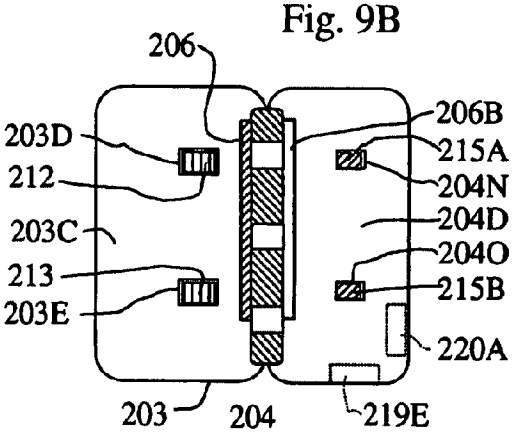
Fig. 9B
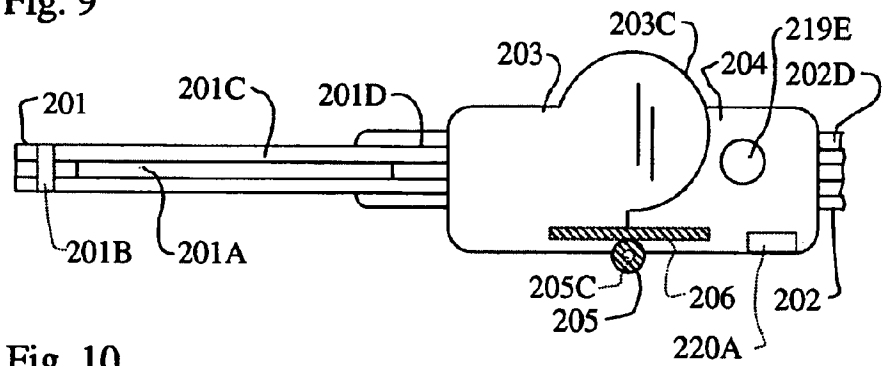
Fig. 10

CONTROLLABLY EXTENDIBLE RESTRAINT INTERCONNECTIONS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND—FIELD OF THE INVENTION

This invention relates to human restraints such as are used by law enforcement officials, and more specifically, to improved devices for controllably, extendibly interconnecting one or more such restraints to each other or to a fixed object.

BACKGROUND—DESCRIPTION OF PRIOR ART

To facilitate this description and the specification to follow, the terms "police officer," "officer," and the like, will often be used as general terms for all law enforcement officials as lawful detainers. Similarly, the terms "arrestee," "prisoner," and "subject" will often be used as general terms for all detainees, whether prisoners or people otherwise lawfully restrained. And similarly, gender specific terms such as "he," or "him," are intended to be understood as implying both male and female gender possibilities as detainers or detainees.

Detainment by material means has been known throughout recorded human history as is well documented in the Bible and other ancient documents. Handcuffs and leg restraints of one form or another, as well as other forms of material restraints, have been in use since antiquity. Generally defined, wrist, leg or other appendage restraints consist of some form of interconnecting linkage between one or more restraint members, or between one or more restraint members and a pre-positioned anchor. Restraint members are typically made of metal, leather, fabric or plastic rings or ring portions that can be encircled and locked about one or more wrists, ankles, or other appendages, or the mid-section, to restrain a detainee, or to fasten him or her to another person or to a pre-positioned object.

The act of detaining an unruly subject by wrist capture and restraint is often a risky affair. Soldiers, police and security personnel, among other officers, often encounter situations where the application of conventional forms of wrist cuffs, i.e., handcuffs, to a subject is made difficult by the refusal of the subject to allow his arms to be brought together behind his back so that the handcuffs may be properly applied to his wrists. Adding to this problem is the fact that conventional restraining devices typically utilize interconnecting linkage methods that place their respective, individual restraint members in close proximity to one another, usually a few inches apart. Often it requires several officers to gain sufficient control over a resisting subject in order to compel his arms into close proximity so that the handcuffs may be attached to his wrists. It would be more advantageous to have a single device that would allow one wrist to be captured by a first restraint, and then briefly allow a second restraint to be moved outward across the required distance to capture the subject's second wrist, and then controllably bring the two restraints together until the device closed to a conventional length.

Officers also often encounter situations where the application of conventional forms of handcuffs or other restraints to an arrestee is complicated by the inability of larger subjects to bring their wrists fully together behind their back. In these situations, an officer might choose to bridge the increased distance between a larger-sized subject's wrists by connecting one handcuff from a first set of handcuffs to a handcuff from a second set, and then place the two remaining, unconnected cuffs about the prisoner's wrists. It would be more advantageous to have a single device with restraints that could be controllably distance-locked to properly reach between a larger subject's wrists, especially when the larger subject is to be handcuffed from behind.

Additionally, once an unruly subject is arrested, it is often difficult for an officer to control the distance which the subject may travel within the processing room during the arrest procedure. Because of the limited reach of conventional handcuff interconnections, the attachment of one conventional handcuff to a pre-positioned wall anchor (such as a wall-mounted eyehook) may prevent the completion of the arrest processing. It would be more advantageous to have a restraint device that would allow a prisoner to be tethered at a reasonable length from a pre-positioned wall anchor.

The majority of prior art references which consider police-employed restraints do so either: a. with a view toward making improvements on the restraints themselves, e.g., different forms of handcuffs or other encircling devices; or, b. with a view toward making improvements on the manner in which the encircling devices are closely connected at fixed distances, e.g., by lengths of chain, hinges, pivots, straps, or other generally fixed interconnections. Very few patent or other prior art references located deal directly with controllably altering the interconnectional distance between restraints or between one or more restraints and a fixed object. Of those few prior art patents which deal with extendible interconnections between restraints, the most relevant are listed below.

U.S. Pat. No. 1,534,936 issued to E. E. Fischbach on Apr. 21, 1925, entitled "Confining and Restraining Device," discloses the use of separate, yet joinable and lockable, strap devices for the quick restraint of an individual. Finger rings at the ends of a strap accommodate a single finger on the detainer's hands thereby allowing the detainer to grasp, with the remaining fingers, the lockable joining means near the finger rings. The detainer is then required to toss the strap over and around the detainee and quickly bring together the joining means. After the strap is joined and locked, the detainer pulls outwardly on the finger rings to further tighten the strap. The detainer must then release his hands from the finger rings or risk being pulled along with arrestee. There is no indication in the reference for using the device to interconnect separated restraints such as handcuffs, nor would it be reasonable to do so with the device. The device has only one continuous cinching strap restraint which is utilized by being looped and cinched around whatever is to be bound within the loop.

U.S. Pat. No. 4,024,736 issued to W. P. DeMichieli on May 24, 1977, entitled "Prisoner Restrainer," discloses a strap rewind reel connected between two ankle cuffs that allows a detainee to walk with a predetermined stride while cuffed. The reel unwinds the strap as the detainee's legs are spread apart, and winds-in the strap as the legs are brought together. A centrifugally-actuated ratchet lock inside the wheel activates if the strap unwinds at an excessive rate, thereby preventing the detainee from assuming a running stride. The reeled strap is not intended to be used to capture an arrestee, but is only utilized as a custodial form of security device to deter a prisoner from attempting a running escape by binding his ankles at the distance set when the ratchet stops the strap. There is no indication in the reference that the device should or could utilize a manually-activated, recoiling-ratchet mechanism for the purpose of assisting the closing of two restraints together. Moreover, the presence of the retractor speed limiter is contrary to the teachings of the present invention.

U.S. Pat. No. 6,026,661 issued to C. Spiropoulos on Feb. 22, 2000, entitled "Restraining Device and Method of Using," discloses a pair of handcuff members, each connected to separate elongated cable sections. The cable sections are attached at their other ends to a rotatable spool that is housed within a manually rotated box-ratchet assembly. A release mechanism enables a user to lengthen the distance between the handcuffs and the housing assembly, thereby lengthening the distance between the separate handcuffs in preparation for their application. The cables are then reeled onto the spool member with a ratcheting motion, thereby joining the handcuffs. The reference does not take into account that without at least a second assisting officer, control over a resisting subject is lost once the initial officer begins using both hands to operate the ratchet and reel mechanism. Additionally, during the reeling process the arrestee would be clearly able to manipulate the overly long cables suggested and use them as a means to ensnare and possible choke or otherwise harm the arresting officer. There is also no indication in this reference that the device should or could utilize a manually-activated recoiling-ratchet mechanism for the purpose of assisting the closing of two restraints together. Moreover, the presence of a manually wound reeling device is contrary to the teachings of the present invention.

SUMMARY

The apparatus of the present invention typically comprises a pair of opposing restraint members wherein a first restraint member is attached to a first end of a thin, flexible, high tensile belt, cord or cable tether, whose second end is attached to a controllably-ratcheted, winding-rewinding spool within a suitable housing. A second restraint member is attached to an opposite end of the housing. The housing may have respective arms which further include a pivotable connection.

When actuated by a user, a controllable ratchet-pawl release mechanism permits the tether to be withdrawn against the tension of the rewinding mechanism. When the ratchet-pawl release mechanism ceases to be actuated, the tether can no longer be extracted and can only be ratcheted back onto the spool while being retracted by the rewinding mechanism, thus bringing the attached opposing restraint members toward a closed connection.

Objects and Advantages

It is an object of the present invention to provide a restraint device that has a controllably extendible interconnection between restraints to enable law enforcement officials to more efficiently control and handcuff a resisting arrestee. It is a further object of the present invention to provide a restraint device for resisting arrestees that will automatically rewind a controllably extendible tether between two restraints, and prevent outreeling by ratcheted control methods. It is another object of the invention to provide restraint members that are detachably attachable to such a restraint device.

It is a still further object of the present invention to provide a controllably extendible restraining device that may be applied to a larger-sized subject to safely secure him in the rear while the restraints are separated by an appropriate distance.

It is a still further object of the present invention to provide a controllably extendible restraining device that may be securely attached to a fixed object such as a pre-positioned wall anchor.

It is a still further object of the present invention to provide a controllably extendible restraining device that may be compactly folded and securely attached to a location adjacent the law enforcement official's body for easy storage, access and implementation. It is a still further object of the present invention to provide a controllably extendible restraining device that is simple to use and more efficient than conventional handcuff devices.

As noted above, the three primary advantages of having controllably extendible restraint interconnections for law enforcement purposes, as opposed to having only fixed distance interconnections, briefly, are that having controllably extendible restraint interconnections allows a law enforcement official: a. to more efficiently subdue an uncooperative person being arrested or detained by providing the officer with a greater reach between a cuffed hand and an opposite hand to be cuffed; b. to better accommodate larger persons whose arm positioning prevents a rear closure of restraints at a conventional length; c. to better controllably restrict the movement of a person about a pivotal fixed object (such as a pre-positioned wall anchor) at an adjustable distance.

There is a clear need for a restraining interconnection system that is more efficient, practical and safer for all individuals involved than the conventional restraining interconnection systems of the prior art, including those currently offered in the marketplace. The present invention of controllably extendible restraint interconnections has been specifically designed to alleviate the difficulties involved in capturing those individuals who resist arrest, or who by their larger order size cannot willfully comply with the restraining process. As well, the present invention of controllably extendible restraint interconnections has been designed to better control unpredictable detainees by tethering them at reasonable distances to fixed points within a processing or other area.

Other objects and advantages of the invention will become clear upon review of the following detailed description in conjunction with the appended drawings.

DRAWING FIGURES

FIG. 9 is a partial cutaway, rear view of the interconnection device of FIG. 3 shown rigidly extended, and detailing the rear hinge and locking bar assemblies.

FIG. 9A is left side view of the hinge assembly and locking bar assembly configuration when the device of FIG. 3 is rigidified.

FIG. 9B is a side view of the hinge assembly and locking bar assembly configuration when the device of FIG. 3 is folded open.

FIG. 10 is a partially cutaway, bottom view of the interconnection device of FIG. 3 shown rigidly extended.

REFERENCE NUMERALS IN DRAWINGS

FIG. 1–2

101=housing
101A=upper axle hub
102=insertion member
103=docking channel
104A=left restraint heel
104B=right restraint heel
105A=left restraint
105B=right restraint
106=tether spool
106A=spool axle
107=retractor spring enclosure
108=retractor spring
109=top ratchet gear
110=bottom ratchet gear
111=ratchet pawl bar
112=pawl spring
113=pawl release bar
113A=top pawl release bar travel slot
113B=bottom pawl release bar travel slot
114=spring-retaining block
114A=spring block aperture
115=tether
116A=counterclockwise block arrow
116B=clockwise block arrow
117A=left-pointing projection arrow line
117B=right-pointing projection arrow line

FIGS. 3–13

201=left handcuff assembly
201A=left single strand
201B=left rivet hinge
201C=left double strand
201D=left heel
201E=left keyhole
201F=left push pin lock hole
201G=left upper heel rivet hole
201H=left lower heel rivet hole
201I=left upper handcuff rivet
201J=left lower handcuff rivet
201K=left ratchet tooth set
202=right handcuff assembly
202A=right single strand
202B=right rivet hinge
202C=right double strand
202D=right heel
202E=right keyhole
202F=right push pin lock hole
202G=right upper heel mounting hole
202H=right lower heel mounting hole
202I=right upper handcuff mounting rivet
202J=right lower handcuff mounting rivet
202K=right ratchet tooth set
203=left housing arm
203A=recessed area for axle top housing
203B=circularly recessed area for retractor spring enclosure bottom
203C=spool enclosure right outside wall
203D=upper tooth receiving aperture
203E=lower tooth receiving aperture
203F=cutaway section of left arm 203
203G=truncated part of left arm 203
204=right housing arm
204A=right arm upper right front and rear rivet mounting hole
204B=lower right rivet front and rear mounting hole
204C=heel receiving aperture
204D=right arm arcurate wall
204E=pawl spring retaining aperture
204F=upper pawl slide hole
204G=lower pawl slide hole
204H=rear mounting block aperture
204I=front mounting block aperture
204J=push bar coil spring aperture
204K=push bar button lower retaining aperture
204L=double-lock button hole
204M=double-lock push pin hole
204N=upper arcurate wall pawl tooth aperture
204O=lower arcurate wall pawl tooth aperture
205=vertical hinge assembly

Figure 14:
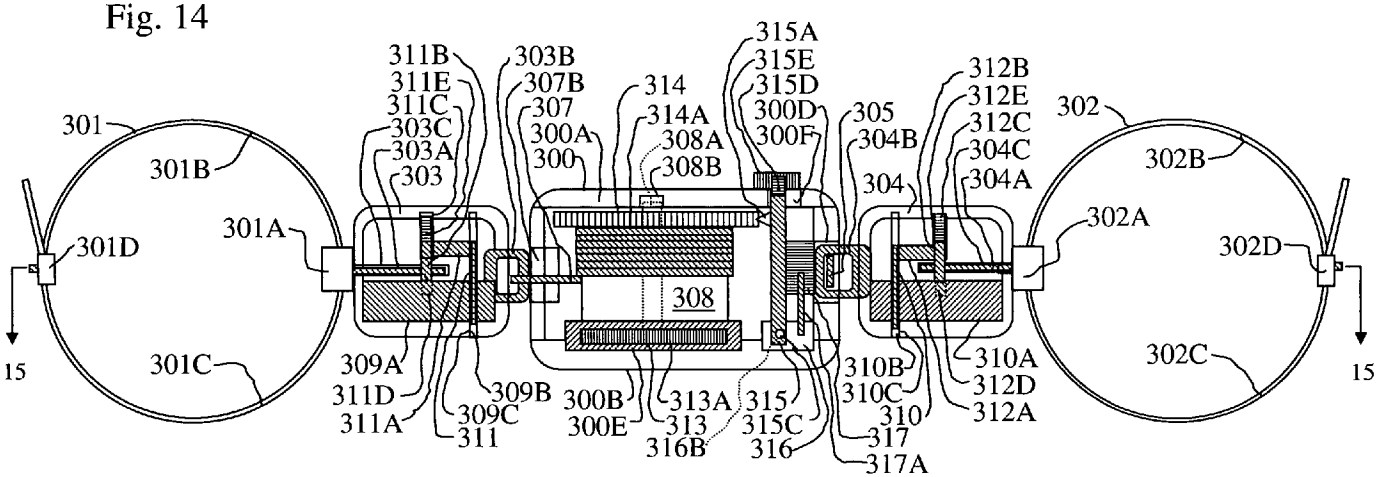
FIG. 14 is a front, transversely-centralized, cross-sectional view of an alternate embodiment of the interconnection device of the present invention wherein a cable is utilized as a tethering method.
Figure 15:
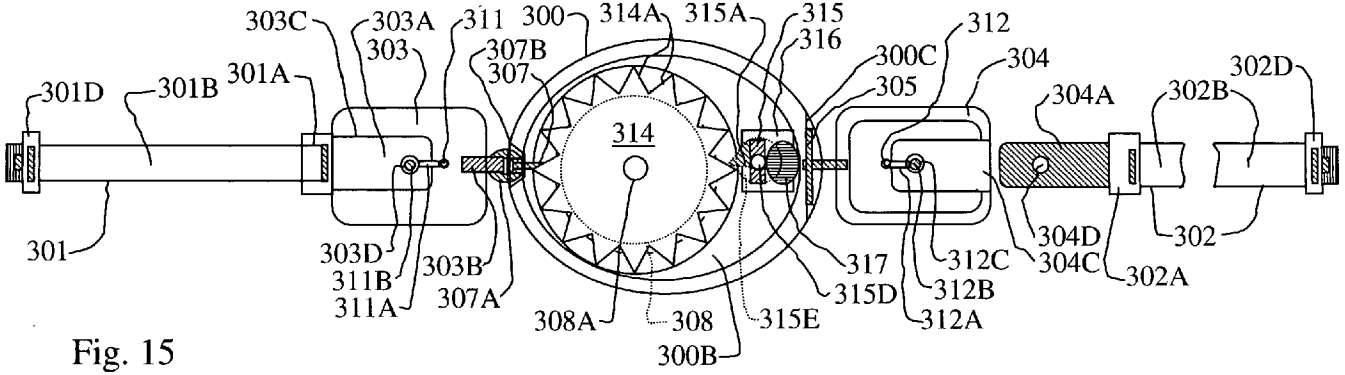
FIG. 15 is a top cross-sectional view of the alternate embodiment of FIG. 14 taken along line 15—15 of FIG. 14.

205A=left hinge pin collars (3)
205B=right hinge collars (4)
205C=hinge pin
206=slidable locking bar
206A=left locking bar storage aperture
206B=right locking bar receiving aperture
206C=locking bar pin aperture
206D=locking bar slide stop member
207=belt tether
208=tether spool
208A=tether spool enclosure
208B=spool vertical axle
208C=upper spool axle housing
209=insertion member
209A=belt clamping slot
210=docking channel
211=insertion member stop bar
211A=upper stop bar slot (filled by stop bar)
211B=lower stop bar slot (filled by stop bar)
211C=vertical belt aperture
211D=vertical brush
212=upper mounted ratchet gear
212A=upper gear teeth
213=lower mounted ratchet gear
213A=lower gear teeth
214=retractor spring enclosure
214A=retractor spring
214B=left locking protrusion
214C=front locking protrusion
215=ratchet pawl bar
215A=upper ratchet pawl tooth
215B=lower ratchet pawl tooth
215C=upper gear bar
215D=lower gear bar
215E=pawl spring bar
215F=notched rear terminus of 215E
215G=spring bar helical spring
215H=upper set of downward-facing gear bar teeth
215I=lower set of upward-facing gear bar teeth
216=spring mounting block
216A=upper endpiece slot (shown filled by 219I)
216B=lower endpiece slot (shown filled by 219J)
217=upper cylindrical gear
217A=front upper gear aperture (shown filled by 217 axle)
217B=rear upper gear aperture (shown filled by 217 axle)
217C=upper cylindrical gear teeth
218=lower cylindrical gear
218A=front lower gear aperture (shown filled by 218 axle)
218B=rear lower gear aperture (shown filled by 218 axle)
218C=lower cylindrical gear teeth
219=push bar
219A=lower push bar gear track teeth
219B=upper push bar gear track teeth
219C=push bar coil spring
219D=push bar end notch
219E=push bar release button
219F=slotted cap aperture
219G=upper push bar guide
219H=lower push bar guide
219I=upper fastening endpiece
219J=lower fastening endpiece
219K=push bar stop disk
220=double-locking assembly
220A=double-lock button
220B=double-lock rod
220C=double-lock guide block
220D=double-lock rod guide hole
220E=double-lock rod stop disk
221=carrying pouch
221A=pouch belt loop
221B=pouch rivets
222=extended pin handcuff key
222A=key barrel
222B=vertical barrel pin
222C=extended handcuff pin
222D=key ring retaining hole FIGS. 14–15
300=central housing
300A=top panel
300B=bottom panel
300C=right wall horizontal slot
300D=right wall vertical slot
300E=retractor spring enclosure receptacle slot
300F=pawl bar top through aperture
301=left loop restraint
301A=left loop retaining member
301B=upper left loop arm
301C=lower left loop arm
301D=left locking detent
302=right loop restraint
302A=right loop retaining member
302B=upper right loop arm
302C=lower right loop arm
302D=right loop locking detent
303=left buckle housing
303A=left buckle tongue
303B=left connector link
303C=left buckle receiving slot
303D=left latch receiving hole
304=right buckle housing
304A=right buckle tongue
304B=right connector link
304C=right buckle receiving slot
304D=right latch-receiving hole
305=right link retaining bar
306A=left latch bar
306B=right latch bar
307=cable tether
307A=cable ring-shaped endpiece
307B=reeling aperture
308=cable tether spool
308A=spool axle
308B=axle housing
309A=left lower mounting block
309B=left cylindrical aperture
309C=left slotted slide tube
310A=right lower mounting block
310B=right cylindrical aperture
310C=right slotted slide tube
311=left slidable cylindrical rod
311A=left slidable cross bar
311B=left latch bar
311C=left latch bar slide tube
311D=left latch bar receiving aperture
311E=left coil spring
312=right slidable cylindrical rod
312A=right slidable cross bar
312B=right latch bar
312C=right latch bar slide tube
312D=right latch bar receiving aperture
312E=right coil spring
313=retractor spring enclosure
313A=retractor spring

314=ratchet gear
314A=ratchet gear teeth
315=pawl bar
315A=pawl tooth
315B=pawl bar mounting hole (filled by 315C)
315C=pawl bar axle
315D=pawl bar threaded top end
315E=pawl bar knurled cap
316=pawl bar mounting block
316A=mounting block vertical slot (shown filled by 315)
316B=front mounting block hole (shown filled by 315)
316C=rear mounting block hole (shown filled by 315)
317=tension block
317A=tension block brace bar
317B=brace bar tension block mounting slot (filled by upper portion of 317A)
317C=lower brace bar mounting slot (filled by lower portion of 317A)

Figure 1:
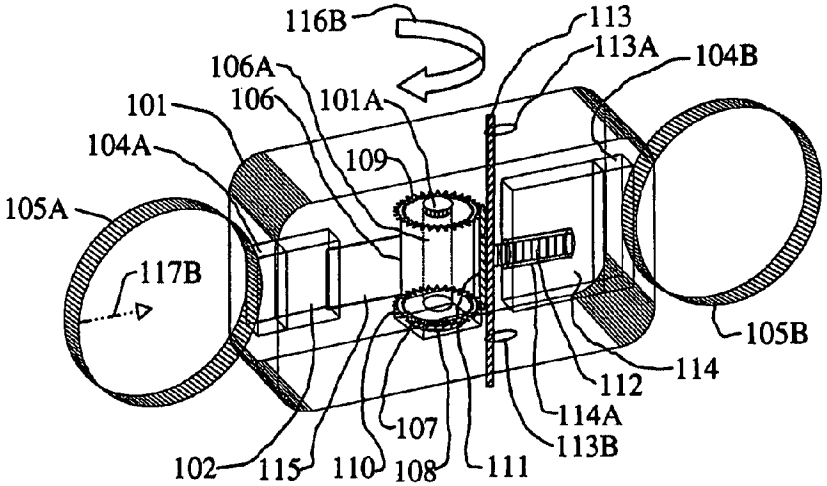
FIG. 1 is a frontal, schematic, perspective view of a preferred controllably extendible restraint interconnection method of the invention.
Figure 2:
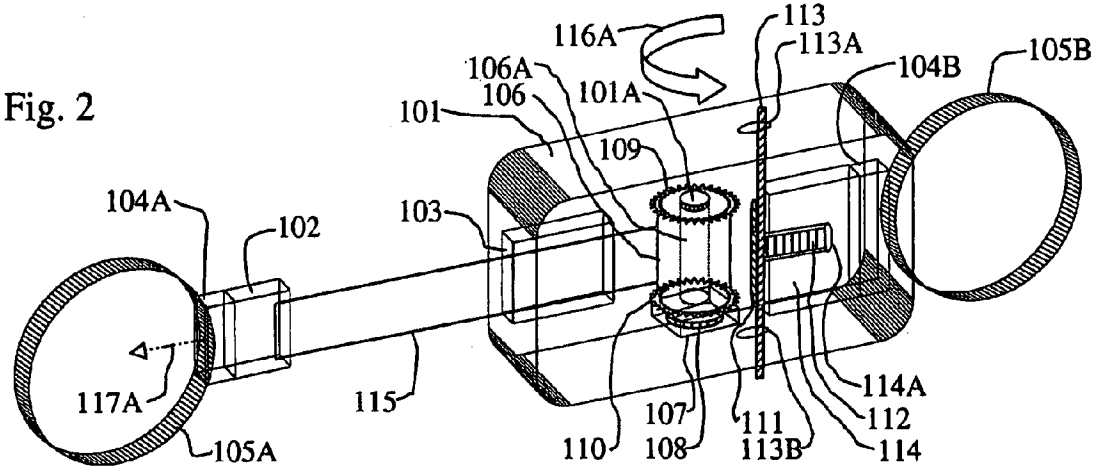
FIG. 2 is a frontal schematic perspective view of FIG. 1 illustrating the extraction of a controllably extendible restraint from its docking channel.
Figures 16, 17:
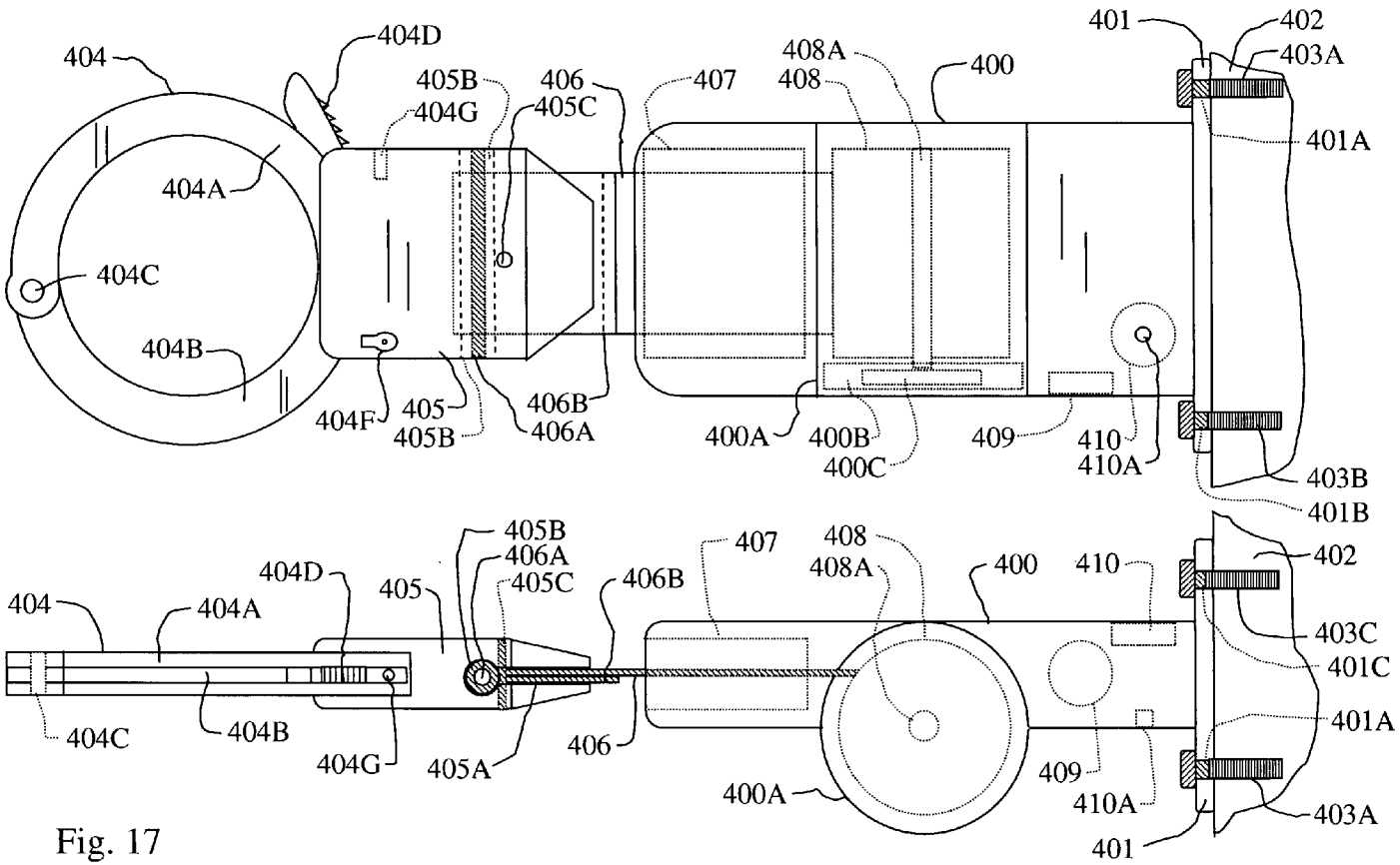
FIG. 16 is a right side view of an alternate embodiment of the invention wherein the back side of an integral housing is shown bolt-mounted to a wall.
FIG. 17 is a top view of the alternate embodiment of FIG. 16.

FIGS. 16–17
400=integral housing
400A=spool enclosure
401=mounting plate
401A=right top hole (filled by bolt 403A)
401B=right bottom hole (filled by bolt 403B)
401C=left top hole (filled by bolt 403C)
401D=left bottom hole (not shown)
402=wall
403A=right top bolt
403B=right bottom bolt
403C=left top bolt
403D=left bottom bolt (not shown)
404=handcuff assembly
404A=double strand member
404B=single strand member
404C=hinge pin
404D=ratchet teeth
404E=pawl (not shown)
404F=frontal keyway
404G=double lock pin hole
405=insertion member
405A=belt slot
405B=cylindrical portion of belt slot
405C=clamping rivet
406=belt tether
406A=belt retaining pin
406B=stitch line
406C=rivet aperture (shown filled by rivet 405C)
407=docking channel
408=spool
408A=spool axle
408B=retractor spring enclosure
408C=retractor spring
409=lock release button
410=double-locking button
410A=pin aperture Description—FIGS. 1–2—Preferred Method of the Invention Preliminary Information In principle, all linked tactical restraints such as handcuffs, shackles, manacles, ankle cuffs, plastic loops, straps, etc., as are well known in the prior art, are "tethered restraints" in that one restraint is tethered by a chain, strap, cable, bar, hinged bar, or pivot to an opposite equivalent or differing restraint, or to a mooring object. Typically, tactical restraints are interconnected or "tethered" by means which vary in length from approximately 25.4 mm (1") to whatever distance is appropriate for the custodial situation.

In the specification to follow, the definition of "tethered restraints" is expanded to mean controllably extendible interconnections between restraints or between restraints and anchored mooring points, such as a pipe or a wall hook, wherein the interconnection between the restraints and/or moorings are controllably extendible in relation to each other, and typically provided with coil-spring retractable, ratcheted tethering means connections between any of the restraint or mooring class members, but which may also reach a rigidified closure point in a common housing between such restraints or moorings. Such a controllably extendible interconnection between restraints and/or moorings as just described will henceforth be known in the specification to follow as a "Controllably Extendible Restraint Interconnection" system, or for brevity, a "CERI" system.

Controllably extendible restraint interconnections, or CERI systems between two or more restraints and/or moorings may be done in one of three ways, either by utilizing rigid materials for the controllably extendible interconnection, or by utilizing a flexible material, or by utilizing a combination of both rigid and flexible materials. It is thus possible to devise controllably extendible interconnections between restraint and/or mooring class members by utilizing a plurality of rigid, interconnected sliding bars or telescoping tubes, or other rigid material extensions, with or without ratcheting and pawl mechanisms incorporated between them. Experiments with rigid material embodiments have shown that these devices will tend to bend during difficult takedown situations. Also, they are not desirable due to their larger-order size and greater weight and cost problems. Longer rigid handcuff assemblies have also not fared well in the marketplace. Another problem, which controllably-extendible rigid restraint interconnections share with conventional hinged-handcuff assemblies, is that they do not afford the detainer an altered angle of attack (orientation) toward effective second wrist capture once the first wrist is captured. It has also not proven to be practical to interconnect flexible tethers with rigid tethers.

The preferred method for producing a practical and effective CERI system is thus with a flexible tethering method, for example, by the utilization of thin, lightweight, high tensile, flexible materials such as are used in the manufacture of nylon seat belt material, or by the utilization of Kevlar™, a tough, light, aramid synthetic fiber. Belts and cords made of such material, as a preferred tethering method between various restraint class members and/or moorings, has proven to be a size, weight and cost efficient method of approaching the various developmental problems of the CERI system embodiments shown and described in the specification below. As well, the use of various forms of spring-retracted cable and belt mechanisms with ratchet-control mechanisms incorporated between the various restraint and mooring class members have led to an easier and more efficient method of appropriately designing a practical CERI system.

Description of a Preferred Method of a CERI System

FIG. 1 is a front schematic perspective view of a preferred controllably extendible restraint interconnection method of the invention. FIG. 2 is a front schematic perspective view of FIG. 1 illustrating the extraction of a controllably extendible restraint from its docking channel.

Referring to FIGS. 1, 2, a rounded, rectangular parallelepiped (box-like) metal or composite material housing 101 is utilized at its left end as an enclosing container for a metal or composite material insertion member 102 which slidably travels within a suitably sized aperture or docking channel 103 (filled in FIG. 1) within the left side of housing 101. Insertion member 102 is suitably attached by bolts or other fasteners (not shown) at its outside (left) end to a left heel 104A of a circular, symbolic, left restraint 105A. Housing 101 is also utilized in its middle area as an enclosing container for a conventional form of metal or composite material cable or belt tether spool 106 with a spool axle 106A suitably connected at its bottom portion to a conventional form of retractor spring enclosure 107 with a conventional internal, coil-type, metal retractor spring 108. Alternately, retractor spring 108 can be replaced by an electrically motorized retractor with a suitably connected power source, such as a battery, and appropriate electric connections and switchwork.

Spool 106 has a set of connected, conventional metal or composite ratchet gears, a top ratchet gear 109, and a bottom ratchet gear 110. Housing 101 also has a metal or composite, spring-actuated ratchet pawl bar 111 actuated by a suitable metal pawl spring 112 which urges pawl bar 111 to engage gears 109, 110. Pawl bar 111 also has a metal or composite manually actuable pawl release bar 113, formed of the same material as pawl bar 111, or made suitably connective, by which pawl bar 111 may be manually, temporarily disengaged from gears 109, 110 against the urging spring force of pawl spring 112. Spring 112 is seated within an aperture 114A in a metal or composite spring-retaining block 114. Pawl release bar 113 slidably travels forward or rearward through a top pawl release bar travel slot 113A and a bottom pawl release bar travel slot 113B provided in housing 101. Alternately, pawl bar 111 may be any other conventional ratchet-locking device associated with any other conventional ratchet-locking and unlocking mechanism.

A circular, symbolic, second or right restraint 105B is suitably attached at a second or right restraint heel 104B by bolts or other fastener methods (not shown) to the right end of housing 101.

In FIGS. 1, 2, first or left restraint 105A with attached insertion member 102 is suitably connected at the forward (right) end of insertion member 102 to a first end of a tether 115. Connection may be performed by a clamping slot and/or rivets or bolts (not shown). Tether 115 is connected at its opposite wound end to tether spool 106 by conventional methods. Tether 115 may be a conventional metal or a Kevlar™ material tether cable, or a conventional fabric or a Kevlar™ tether belt.

In FIG. 1, tether 115 is shown shorter indicating that insertion member 102 is fully retracted by retractor spring 108 into docking channel 103, and that spring-actuated ratchet pawl 111 is currently engaged with gears 109, 110 by the urging force of pawl spring 112. In FIG. 2, tether 115 is shown longer indicating that insertion member 102 has been extracted from docking channel 103. FIG. 2 also shows ratchet pawl 111 being temporarily moved away from gears 109, 110 by pawl release bar 113 thus rearwardly compressing pawl spring 112 through aperture 114A into spring-retaining block 114.

Tether spool 106 with wrapped cable or belt tether 115, along with connective top and bottom ratchet gears 109, 110 and retractor spring enclosure 107 with retractor spring 108, are made suitably connective within central housing 101 by inserting an upper hub 101A for spool axle 106A into the upper inside material of housing 101 and by pressure fitting lower retractor spring enclosure 107 into the inside bottom material of housing 101, or by other suitable retaining methods.

Counterclockwise block arrow 116A and clockwise block arrow 116B indicate tether spool 106 rotational directions and are explained more fully below. Left-pointing projection arrow line 117A and right-pointing projection arrow line 117B respectively indicate left restraint 105A left and right movement and are explained more fully below.

Operation—FIGS. 1–2—Preferred Method of the Invention

Referring to FIG. 2, manual removal of left restraint heel 104A from housing 101 is only possible when pawl release bar 113 has been manually, slidably actuated to disengage pawl bar 111 from ratchet gears 109, 110. This is typically done by using an upper and lower portion of a user's hand to simultaneously, rearwardly urge the respective upper and lower portions of pawl release bar 113 with connective pawl bar 111 away from gears 109, 110, thus urging pawl spring 112 into a higher state of tension. When manually urged, pawl release bar 113 slidably travels rearward through top pawl release bar travel slot 113A and bottom pawl release bar travel slot 113B and pawl spring 112 compresses through spring aperture 114A into spring block 114.

Still referring to FIG. 2, left-pointing projection arrow line 117A indicates the direction of manual removal of left restraint heel 104A and attached insertion member 102 away from docking channel 103. Such a manual removal pulls along attached tether 115 which then unwinds counterclockwise from tether spool 106, as indicated by block arrow 116A. This action then causes retractor spring 108 in retractor spring enclosure 107 to wind into a higher state of tension.

Referring to FIG. 1, a right-pointing projection arrow line 117B indicates the direction of travel for the insertion of left restraint heel 104A with attached insertion member 102 back into docking channel 103 once pawl release bar 113 has been manually released and pawl spring 112 has urgingly reacted to again re-engage pawl bar 111 within ratchet gears 109, 110. Pawl bar 111 is then set to only allow a slidably clockwise passage of ratchet gears 109, 110 past pawl bar 111 as indicated by clockwise block arrow 116B. Since retractor spring 108 in retractor spring enclosure 107 was placed in a higher state of tension by the manual removal of left restraint 105A (as shown in FIG. 2), spring 108 is now urging tether 115 to rewind. Tether 115 will then only pull insertion member 102 with attached left restraint heel 104A toward docking channel 103, and engaged pawl bar 111 will then forcibly stop ratchet gears 109, 110 from turning counterclockwise, and thus prevent tether 115 from being further unwound. Thus, if an arrestee or other detainee has had his wrists (or other appendages) placed into respective restraints 105A, 105B while tether 115 was extended and pawl bar 111 re-engaged, it will no longer be possible for him (or her) to separate his wrists, but only bring them closer together with each successive movement of the ratchet teeth in gears 109, 110.

Alternately, other CERI system methods may be utilized such as would involve: a. a reconfiguration of the aforementioned elements in relation to one another, e.g., a spool and ratchet assembly that has a differing orientation from vertical, or an alternate interconnection of one or more restraints in a differing configuration; or, b. a replacement of a spool and ratchet assembly with an alternate form of controllably releasable-engagable tether extraction and retraction mechanism such as an alternate form of spool and/or ratchet and pawl assembly, or an alternate form of spring return system for a tether, or any other mechanical variation which yet allows a CERI device to function in terms of the given method of the invention.

Description—FIGS. 3–13—Preferred Embodiment of the Invention

In terms of the preceding method of a controllably extendible restraint interconnection, or CERI system, although the preferred embodiment will be specified below in terms of a "belt tether," the terms "tether" or "tethering means," as used herein to describe and claim the present invention should be understood (with explained modifications) to cover tether members having cross sectional shapes other than flat, and may include circular or other shapes such as would describe cords, cables, or other flexible interconnections between restraints.

In the preferred embodiment of a CERI system shown in FIGS. 3–13, the type of handcuffs, represented in the drawings generally, left handcuff assembly 201 and right handcuff assembly 202, are known as a set of "swing-through" handcuffs. Typically in swing-through handcuffs, a lower arcurate portion of the respective left and right handcuffs 201, 202, commonly known as a "single strand" member, being a left single strand 201A and a right single strand 202A, are respectively rivet-hinged with a set of rivet hinges 201B, 202B to their respective upper arcurate "double strand" members, being a left double strand 201C, and a right double strand 202C. The respective hinges 201B, 202B connect single strands 201A, 202A within double strands 201C, 202C through suitably sized holes (shown filled by rivet hinges 201B, 202B) at their respective swinging ends so that movable single strands 201A, 202A may respectively "swing through" the fixed position double strands 201C, 202C. The outer portion of the free end of each single strand 201A, 202A has a set of ratchet teeth (not shown) which when swung around on rivet hinges 201B, 202B reach a ratcheting interconnection with opposing ratchet teeth on a spring actuated pawl (not shown) within the respective heels 201D, 202D of the handcuff mechanism. In FIGS. 3–13, the left upper double strand 201C and left lower single strand member 201A, and the right upper double strand member 202C and right lower single strand member 201A are shown closed on their respective hinges 201B, 202B and thus have ratcheted connections with their respective pawls (not shown).

Figure 7:
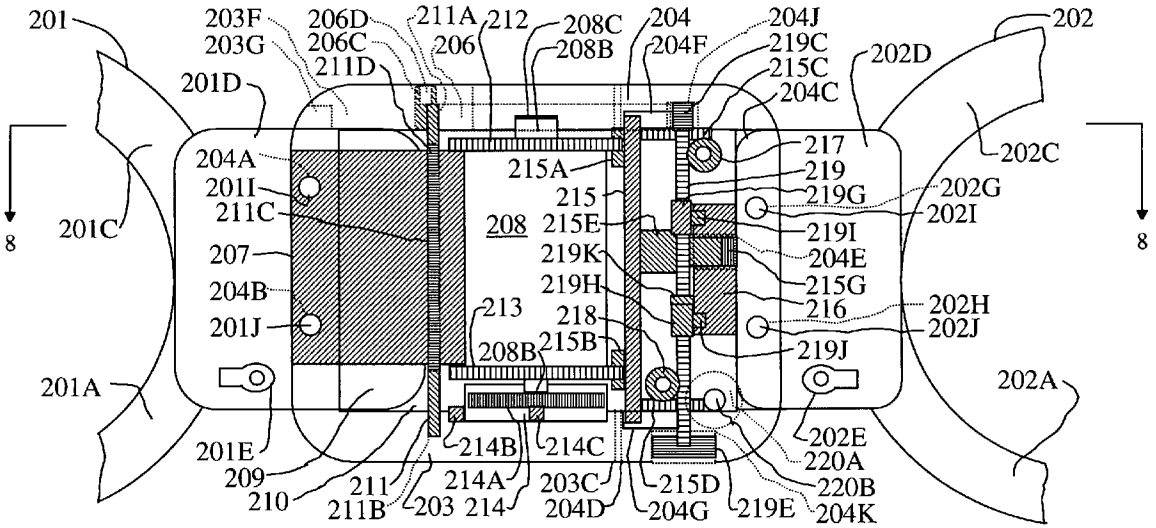
FIG. 7 is a front, partially cutaway, enlarged scale, cross-section view taken along line 7—7 of FIG. 4.
Figures 7A, 7B, 7C, 7D:
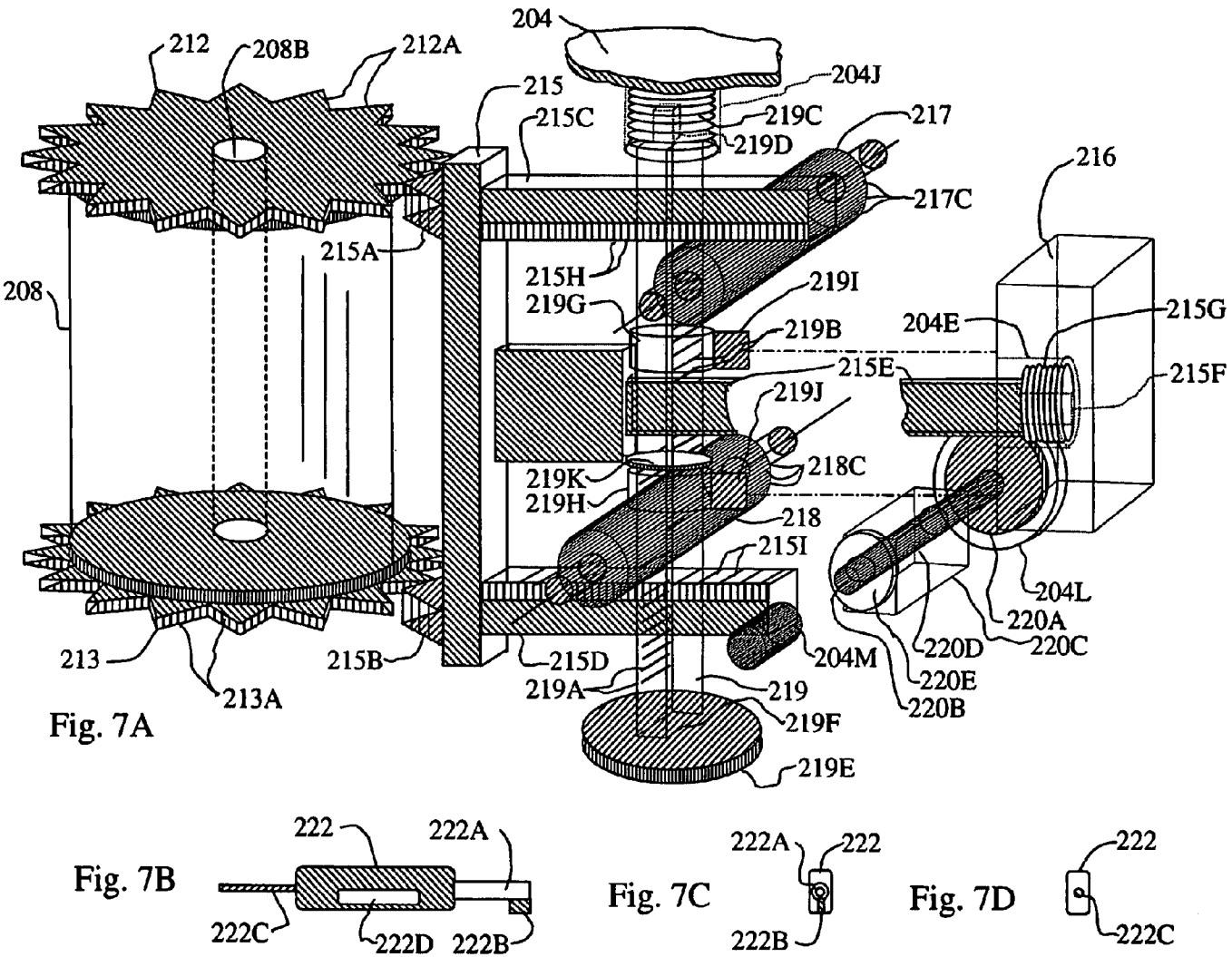
FIG. 7A is a front, diagrammatic perspective, stand-alone view of the ratchet control assembly shown in FIGS. 7 and 8.
FIG. 7B is a right side view of an extended pin handcuff key.
FIG. 7C is a front view of FIG. 7B.
FIG. 7D is a rear view of FIG. 7B.

Typically, swing-through handcuffs are made from machined aluminum or titanium steel, and have a left and a right first locking-unlocking mechanism and appropriately positioned first locking-unlocking mechanism front keyways, or keyholes 201E, 202E for a standard-sized handcuff key (FIGS. 7B–7D). Such conventional handcuffs also typically have a set of push pin lock holes 201F, 202F containing a push-pin lock for double-locking the first lock mechanism which is actuated by a pin extension on the reverse end of the handcuff key known as a double-lock actuator. Swing-through handcuffs are typically ratcheted loosely closed onto the wrists of subjects being arrested or otherwise detained or restrained to prevent escape or to prevent injury to themselves or others. The push-pin lock serves to prevent the ratchet from moving away from the pawl and so prevents further closure on the subject's wrists.

The first locking-unlocking mechanism, when operated by the handcuff key within holes 201E, 202E in one direction releases the double-ratchet lock, and when turned in the other direction releases the ratchet grasp and allows single strands 201A, 202A to be dropped away from the subject's wrists. Typically, when conventional non-extendible restraint interconnections are used with this type of left and right swing-through handcuffs, they are closely interconnected to within a few inches of each other by utilizing steel chain, solid blocks, or by various types of pivots or hinging mechanisms.

Figure 3:
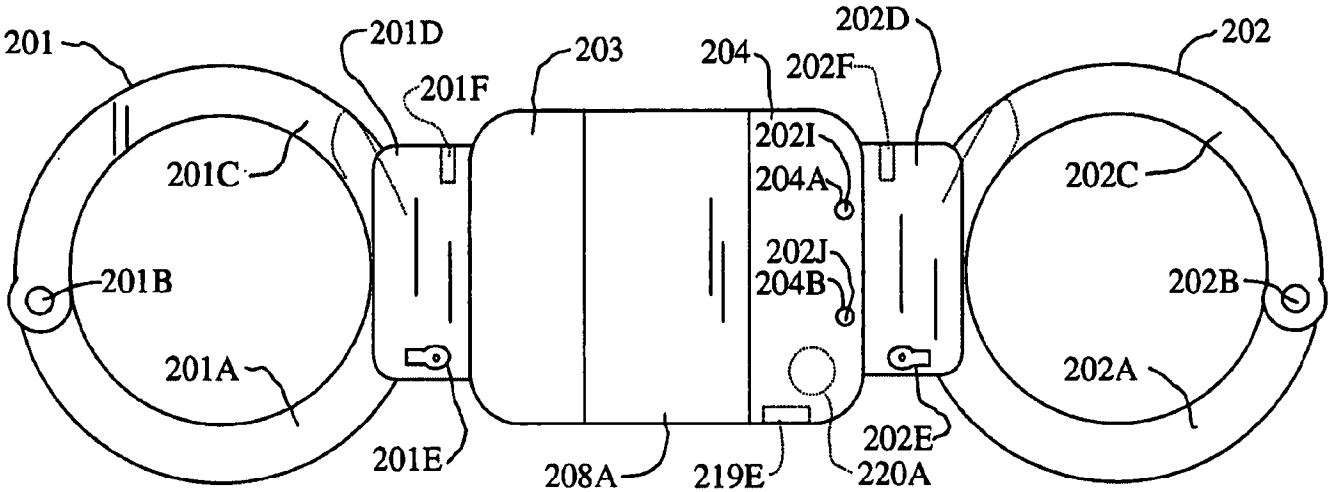
FIG. 3 is a front view of a preferred embodiment of a controllably extendible restraint interconnection device of the present invention shown unfolded and rigidly extended.

FIG. 3 is a front view of a preferred embodiment of a controllably extendible restraint interconnection device, or CERI system, of the present invention. The preferred CERI embodiment of FIG. 3 may be made in one of two primary ways, either as an integral rigid unit such as was shown in FIGS. 1, 2, or as a foldable unit composed of separate, opposing, pivoting arms which are unfolded and mechanically rigidified when the device is to be used. In the description below, the device will be explained as a foldable device. However, the same descriptive account would apply to an integral rigid embodiment of the device whenever components used exclusively to provide foldability are disregarded.

Figure 4:
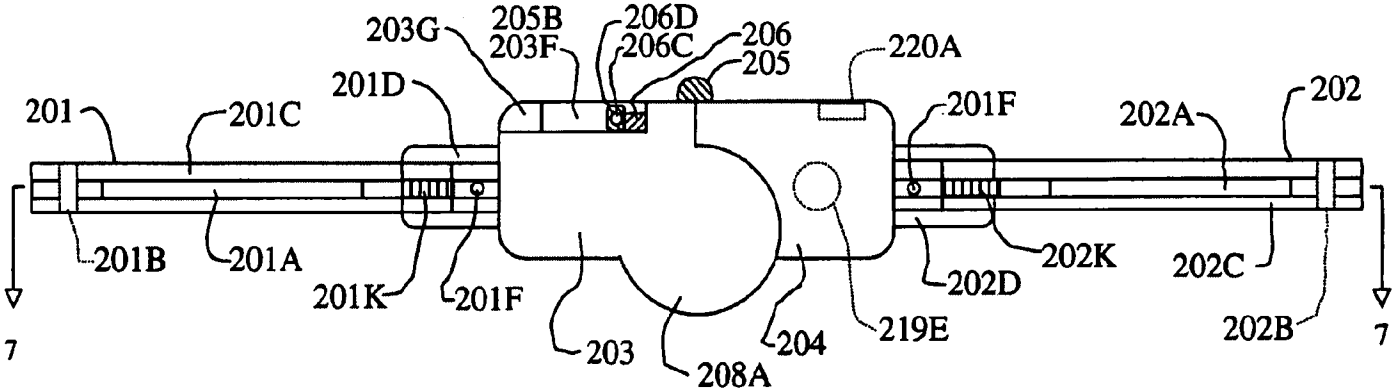
FIG. 4 is a top view of the interconnection device of FIG. 3 shown rigidly extended.
Figure 11:
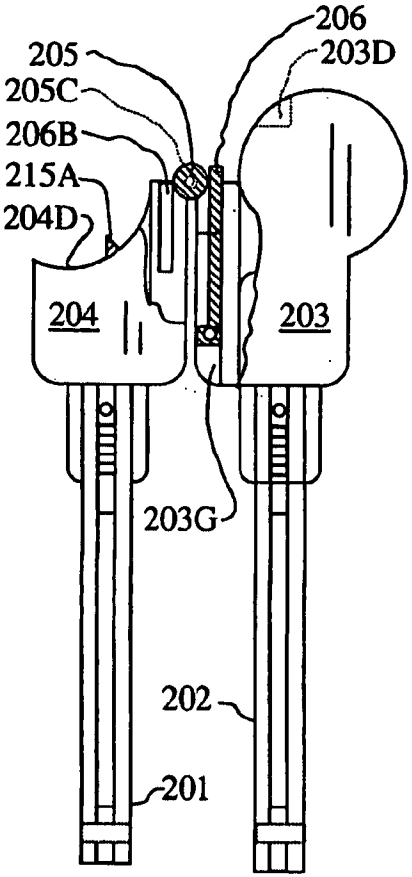
FIG. 11 is a top, partially cutaway view of the interconnection device of FIG. 3 shown folded in half with its opposing restraints substantially parallel.

Regarding the preferred CERI device of FIGS. 3–13 as a foldable device then, FIG. 4 is a top view of the restraint interconnection device of FIG. 3. FIG. 9 is a rear view of FIG. 3, and FIG. 10 is a bottom view of FIG. 3. The preferred interconnection device of FIGS. 3, 4, 9, 10, is primarily comprised of two separate housing arms, a first or left housing arm 203, and second or right housing arm 204 which are connected together at the rear by a vertical hinge assembly 205, and which are rigidified by an internal sliding locking bar 206 which slidably travels from a left arm storage aperture 206A into a slotted receiving aperture 206B (FIG. 9B, 11; otherwise shown filled by bar 206) in right arm 204. Hinge 205 as seen from the top in FIG. 4, and from the rear in FIG. 9, allow the integral device comprised of arms 203, 204 to be folded in half, back-to-back, along a bisecting vertical hinge pin 205C when slidable locking bar 206 is disengaged. When folded, the device appears as shown in FIGS. 9B, 11. Hinge 205 and locking bar 206 will be explained more fully below.

Left housing arm 203 and right housing arm 204 are typically made of metal or hardened plastic resin composites with thick walls, and are typically made in a box-like form with appropriate screw-down top and bottom cover plates (not shown) so that their inner mechanisms can be properly introduced and maintained. Right angled sides of the respective housings 203, 204 typically have their edges rounded wherever a human hand may incur possible harm during use of the device. Except for minor protrusions and apertures (to be explained below), respective arms 203, 204 are enclosed units which cooperatively function as an integral unitary device.

Considering the device of FIGS. 3, 4 initially as a rigid, integral unit, FIGS. 3, 4 show left housing arm 203 and right housing arm 204 each with an associated connective restraint, a first or left metal restraint handcuff 201 and a second or right metal restraint handcuff 202, each having a respective handcuff heel, left handcuff heel 201D and right handcuff heel 202D.

Figure 5:
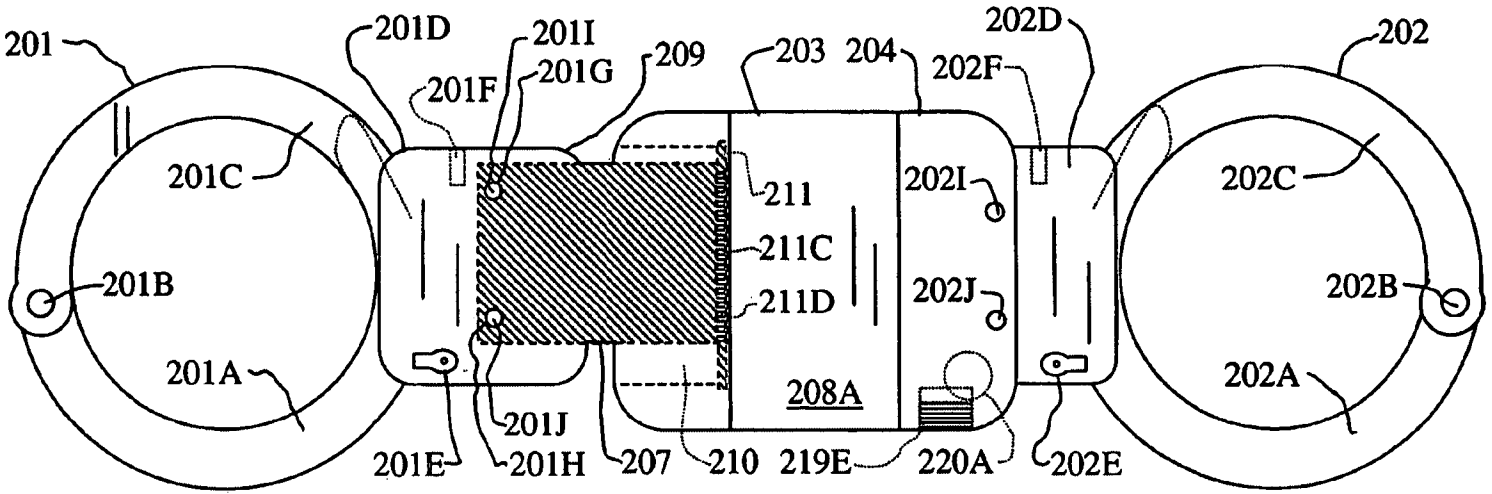
FIG. 5 is a front view of the interconnection device of FIG. 3 showing the left restraint separated from its docking channel along the line of a belt tether.
Figure 6:
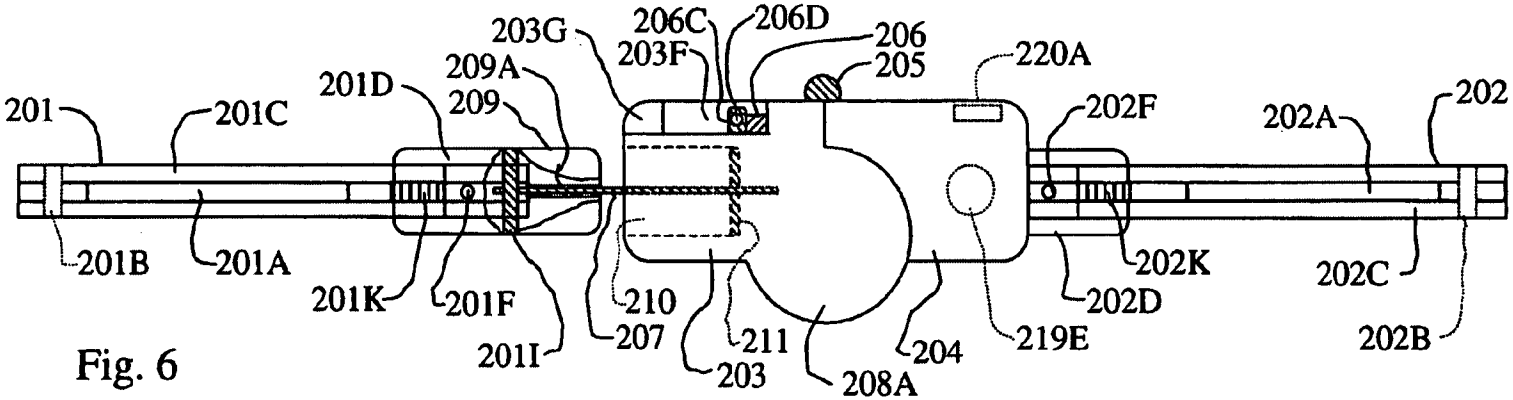
FIG. 6 is a top view of the interconnection device of FIG. 3 showing the left restraint separated from its docking channel along the line of a belt tether.

FIG. 5 shows a front view of the interconnection device of FIG. 3 showing left handcuff 201 with left heel 201D separated from left housing arm 203 along the line of an interconnected belt tether 207 which has been extracted from a tether spool 208 within a tether spool enclosure 208A in left housing arm 203. Left heel 201D has an extended right portion which serves as an insertion member 209 which slidably engages and traverses a docking channel 210, which is a box-like aperture in the left side of left arm 203. Docking channel 210 is suitably sized and configured to slidably receive insertion member 209 in a close-fitting manner. FIG. 6 shows a top view of the interconnection device of FIG. 3 showing left restraint 201 and left heel 201D with extended portion insertion member 209 separated from left housing arm 203 along the line of belt tether 207. Insertion member 209 is made vertically and horizontally symmetrical to avoid re-entry problems into docking channel 210 in the event that one of the handcuffs is accidentally applied in an inverted position and left handcuff 201 must be received with belt tether 207 inverted into docking channel 210.

Figure 8:
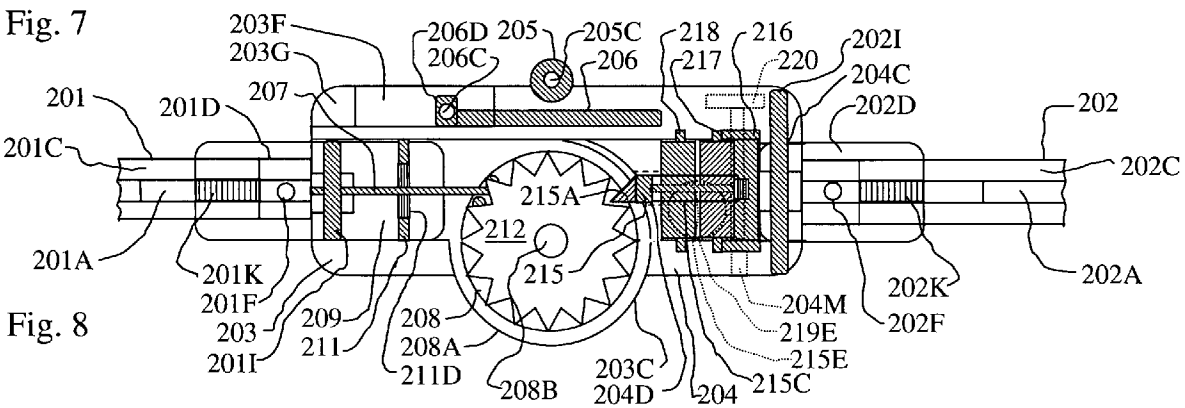
FIG. 8 is a top, partially cutaway, enlarged scale, cross-sectional view taken along line 8—8 of FIG. 7.

Referring to FIGS. 7, 8, belt tether 207 passes from tether spool 208 to its connection with insertion member 209 through a metal or composite, slotted, vertically disposed, insertion member stop bar 211. When belt tether 207 is fully rewound as shown in FIGS. 7, 8, insertion member 209 comes to rest in docking channel 210 against vertical stop bar 211. Stop bar 211 is mounted between the upper and lower inner material of left arm 203 in upper stop bar slot 211A and lower stop bar slot 211B (shown filled by stop bar 211). Vertical stop bar 211 has a vertical aperture 211C which is suitably sized for belt tether 207 to freely travel through. Typically, stop bar 211 will have a vertical brush 211D with horizontal-disposed nylon or other type of bristles which brush against the sides of belt 207 as it passes inward through vertical aperture 211C. Any accumulated debris from the brushing of belt 207 is then tamped out through docking channel 210 when insertion member 209 is withdrawn. Any debris within spool enclosure 208A may be removed when the left housing arm covers (not shown) are removed, or, alternately, a tamping hole with a suitably sized rubber-like material cover plug may be provided at the bottom of right arm 204 for removal of debris from spool enclosure 208A.

FIG. 7 is a front, partially cutaway, enlarged scale, cross section view of the interconnection device of FIGS. 3, 4 taken along line 7—7 of FIG. 4. FIG. 7 shows the integral device rigidly extended and reveals a conventional form of ratcheted tether spool 208 with an upper mounted ratchet gear 212, a lower mounted ratchet gear 213, and a lower mounted retractor spring enclosure 214 with retractor spring 214A. FIG. 8 is a top, partially cutaway, enlarged scale, cross section view of FIG. 7 taken along line 8—8 of FIG. 7. Referring to FIGS. 5–8, right handcuff 202 has a heel 202D which serves as a vertical mounting portion which has a set of provided suitably sized and configured mounting holes 202G, 202H through which a set of suitably sized, metal, right handcuff mounting bolts or flush rivets, an upper right handcuff rivet 202I, and a lower right handcuff rivet 202J may be respectively passed through right heel 202D for secure fastening through a set of suitably sized holes, an upper right rivet hole 204A, and a lower right rivet hole 204B within the front and rear walls of a suitably sized heel-receiving aperture 204C (FIG. 7) in the right side of right arm 204. Left handcuff 201 has an extended heel 201D (which includes insertion member 209 portion) provided with a set of rivet holes, an upper left rivet hole 201G, and a lower left rivet hole 201H, through which suitably sized metal or composite material bolts or flush rivets, an upper left handcuff rivet 201I, and a lower left handcuff rivet 201J are passed. When fastened, rivets 201I, 201J force together the two sides of a vertical and horizontal belt clamping slot 209A within insertion member 209 (filled by belt tether 207). Clamping slot 209A is sized to receive the end of a thin, approximate 31.75 mm (1.25") high, 60.9 cm (2') long, fabric belt tether 207, typically made of nylon or Kevlar™ with a tensile strength greater than 300 lb. to satisfy the breakaway limit requirements of the National Institute of Justice standards for handcuffs. Belt tether 207 has provided a set of two suitably sized and configured holes, and upper belt hole 207A (not shown), and a lower belt hole 207B (not shown), which allow passage of rivets 201I, 201J. Rivets 201I, 201J tightly compress the inserted left end of belt tether 207 within slot 209A. Typically, belt 207 will be slightly folded over prior to insertion of holes 207A, 207B and the insertion of rivets 201I, 201J to add strength to the connection between belt 207 and insertion member 209. Belt 207 is further restrained from movement by being clamped within insertion member 209 through the compression action of its structure. This maintains belt 207 firmly in a horizontal position and parallel to left arm 203.

Alternately, left cuff heel 201D and insertion member portion 209 may be made as separate members which are made connective by a slot and protrusion method, or by another fastening arrangement between themselves utilizing rivets 201I, 201J and holes 201H, 201J or other fastening arrangements. And alternately, the tethered end of belt 207 may be folded over around a vertical retaining pin and stitched. A suitably sized containment and compression area would then be provided within insertion member 209 for retention of the retaining pin.

Referring to FIGS. 5–8, belt 207 extends from its clamped end within insertion member 209 to a metal or plastic composite belt spool 208 such as is conventional in the art of seat belt spool manufacturing. Spool 208 is contained within a spool enclosure 208A within left arm 203 where belt 207 is wound flat about belt spool 208. Spool 208 is mounted onto a suitably sized cylindrical metal vertical axle 208B which is held in place at its top by a recessed internally cylindrical, metal upper axle housing 208C sized to rotatably accommodate the top of axle 208B. Axle housing 208C is typically form-fit into a recessed area 203A within the upper inside material portion of left arm 203 (shown filled by axle housing 208C). The bottom portion of axle 208B is typically rectangularly shaped, or rounded and slotted, and sized to fit within the top middle portion of an external retractor spring enclosure receptacle (not shown) within retractor spring enclosure 214, such as is conventional in the art of seat belt retractor manufacturing. Referring to FIGS. 7, 8, spool 208 has been sized smaller than a conventional seat belt retractor spool and is only intended to wind approximately 45.7 to 60.9 cm (18" to 2') of thin nylon or Kevlar™ belt.

Retractor spring enclosure 214 has a conventional coil retractor spring 214A which is in a relaxed state when belt 207 has been wound during a clockwise rotation of axle 208B. In FIGS. 7, 8 belt 207 is considered to have been wound around spool 208 when spool 208 was turned in a clockwise direction if viewed from above, and so spring 214A is in a relaxed state in FIGS. 7, 8. If, as shown in FIG. 5, 6, belt 207 is pulled outward to unwind from spool 208, spool 208 turns counterclockwise to unwind belt 207 and thus winds coil retractor spring 214A within retractor spring enclosure 214 to a state of higher spring tension. Retractor spring enclosure 214 is circularly shaped on the outside and has two locking protrusions, left locking protrusion 214B, and front locking protrusion 214C, which fit within suitably sized recesses within a circularly recessed area 203B (all shown filled by enclosure 214) within the lower material of left arm 203. The positioning of the bottom of retractor spring enclosure 214 and protrusions 214B, 214C are determined by the vertically disposed, fixed positioning of spool axle 208B. When retractor spring enclosure 214 is properly seated within the bottom base material it cannot rotate or otherwise move when winding tension is applied to spool 208 and axle 208B as belt 207 is pulled from spool 208.

Alternately, retractor spring 214A may be additionally provided with a braking mechanism such as is conventional in the art to slow the rate at which retraction occurs. Alternately, retractor spring 214A can be replaced by an electrically motorized retractor with a suitably connected power source, such as a battery, and appropriate electric connections and switchwork.

The top plate portion of spool 208 is made in the form of a circular, hardened metal or resin composite ratchet gear 212 which rotates with spool 208 and axle 208B. Equivalently, the bottom plate portion of spool 208 is made in the form of a circular, hardened metal or resin composite ratchet gear 213 which rotates with spool 208 and axle 208B. A hardened metal ratchet pawl bar 215 with a leftward-protruding set of slide-or-stop teeth, an upper pawl tooth 215A, and a lower pawl tooth 215B, such as are conventional in the art of seat belt and other ratchet assembly manufacturing, is positioned to the right of gears 212, 213. Pawl teeth 215A, 215B, as shown in FIGS. 7, 8, 9B, 11, protrude through provided apertures, an upper pawl tooth aperture 204N, and a lower pawl tooth aperture 204O, in a left-facing arcurate wall 204D of right arm 204 so that during a foldable separation and re-connection of arms 203, 204, pawl teeth 215A, 215B will fall into place against spool ratchet gears 212, 213. Spool enclosure right side wall 203C in left arm 203 has an equivalently sized set of pawl teeth receiving apertures, an upper tooth receiving aperture 203D as shown in FIGS. 7, 8, 9B, 11, and a lower tooth receiving aperture 203E, as shown in FIG. 9B and indicated in FIG. 7.

Referring to FIG. 7, pawl bar 215 is positioned between an upper slide hole 204F and a lower slide hole 204G formed respectively into portions of the inside top and bottom material of right arm 204, or into a metal or composite box set within the top portion of the inner material of left arm 203. Slide holes 204F, 204G allow ratchet pawl bar 215 to move slightly forward and backward and also prevent ratchet pawl bar 215 from shifting sideways during a situation where belt tether 207 is being pulled against the resistance of pawl bar 215 when it is lockably engaged in gears 212, 213. Pawl bar 215 is sized, configured, and positioned with respect to any provided size and shape of ratchet gear teeth, for example, upper gear teeth 212A, and lower gear teeth 213A (FIG. 7A) to either allow gear teeth 212A, 213A to slide past bar teeth 215A, 215B during a clockwise rotation, or to engage bar teeth 215A, 215B whenever spool 208 and axle 208B are induced to attempt a counterclockwise rotation.

Alternately, pawl bar 215 may be any other conventional ratchet-locking device associated with any other conventional ratchet-locking and unlocking mechanism, as is generally known to those skilled in that art, utilized with any practical size ratchet gear or gears of any workable ratchet tooth design and configuration, e.g., vertical teeth rather than horizontal, and the ratchet pawl release assembly may be placed anywhere in the configuration of the device, e.g., over vertical teeth rather than horizontally adjacent to, so long as it operates the pawl release and does not interfere with the operation of the device during the restraining process.

FIG. 7A is a frontal, diagrammatic perspective, standalone view of the ratchet control assembly shown in FIGS. 7 and 8. Referring to FIGS. 7, 7A, 8, at the back side of ratchet pawl bar 215 is a ratchet-locking-unlocking mechanical assembly, or ratchet control assembly, generally, to the rear (right) of ratchet pawl bar 215, which is generally positioned between the back side of pawl bar 215 and the inside portion of the right side of right housing arm 204.

Vertical ratchet pawl bar 215 has three horizontally disposed, right-facing, right-angled extensions which connect it with the remaining parts of the ratchet control assembly, being a longer metal or composite upper gear bar 215C, a lower, slightly shorter metal or composite gear bar 215D, and a metal or composite pawl spring bar 215E positioned between gear bars 215C and 215D. In FIG. 7A spring bar 215E is shown (with projection lines) as being separated in approximately its middle portion in order to better view the ratcheting assembly components.

Referring to FIGS. 7, 7A, 8, spring bar 215E is typically a flat plate made in a right-angled, general T-shape with the T-top parallel to pawl bar 215. The rear (right) portion of spring bar 215E is sized smaller than the front (left) portion and suitably sized and notched so that its rear terminus 215F will fit securely within the front inner coil portion of a suitably sized, metal or composite helical spring 215G. Spring 215G is positioned within a suitably sized, spring-retaining aperture 204E within a metal or composite, cross-mounted spring mounting block 216. Block 216 is either formed from the inside back (right) wall material of right arm 204, or is set within two suitably sized apertures, a rear aperture 204H and a front aperture 204I within the inside material of the front and rear walls of right arm 204 (shown filled by block 216). Gear bars 215C, 215D and spring bar 215E are either formed from the material of pawl bar 215, or otherwise affixed by spot welding or other suitable fastening methods. When vertical pawl bar 215 moves horizontally within slide holes 204F, 204G, attached gear bars 215C, 215D and spring bar 215E move equivalently. Gear bars 215C, 215D are provided with opposing, equivalent sets of gear teeth, respectively, an upper set of downward-facing gear bar teeth 215H, and a lower set of upward-facing gear bar teeth 215I. Spring 215G biases spring bar 215E with connective pawl bar 215 and pawl teeth 215A, 215B, and connective gear bars 215C, 215D to a forward (leftward) position.

Between gear bars 215C, 215D are two metal or composite cylindrical gears, an upper cylindrical gear 217, and a lower cylindrical gear 218, which respectively have extended axle portions which fit within suitably sized apertures within the inside material of front and rear walls of right arm 204. Upper gear 217 is rotatably set within a front upper gear aperture 217A, and a rear upper aperture 217B, and lower gear 218 is rotatably set within a front lower gear aperture 218A and a rear lower gear aperture 218B (shown filled by the respective gear axles). Gears 217, 218 respectively have an encircling set of upper cylindrical gear teeth 217C and lower cylindrical gear teeth 218C respectively set around their perimeters. Gear teeth sets 217C, 218C are respectively sized and configured to rotatably interact with gear bar teeth sets 215H, 215I.

Set between cylindrical gears 217, 218 is a metal or other material push bar 219. Push bar 219 is a vertically disposed, manually actuated, downwardly spring-biased, gear bar. On its lower, left-facing portion, push bar 219 has a lower gear track with a set of lower gear teeth 219A, and on its opposing upper, right-facing portion, push bar 219 has an upper gear track with a set of upper gear teeth 219B. Gear teeth sets 219A, 219B rest respectively within cylinder gears 217, 218, and are sized and configured to be enabled to engage and rotatably interact with gears 217, 218. Push bar 219 is shown in FIGS. 7, 7A, 8 as a flat bar, but may alternately have any shape which preserves a sufficient portion of gear track teeth 219A, 219B to interact with and actuate cylinder gears 217, 218.

At its upper terminus, push bar 219 is suitably mated with a metal or composite push bar coil spring 219C at a push bar end notch 219D (FIG. 7A), which is a narrowed portion of the upper terminus of push bar 219 which is snugly insertable within coil spring 219C. Coil spring 219C is set within a push bar coil spring aperture 204J, or within a suitably made metal or other material containment box, within the upper inside material of right arm 204. At its lower terminus, push bar 219 has a metal or composite push bar cap, or push bar release button 219E fastened either by pressure fit, with or without adhesive, into a suitably sized, slotted cap aperture 219F, or is otherwise suitably fastened thereupon. Release button 219E is typically an inversely domed or truncated, fingertip-sized metal or composite, rounded or otherwise shaped button member. Release button 219E is slidably contained within a suitably sized and shaped release button aperture 204K (FIG. 7) in the bottom material of right arm 204 in a middle position between the front and rear sides of right arm 204. Release button 219E is slightly recessed within aperture 204K both so that it may be easily located for actuation by a user's fingertip as it travels along the bottom of right arm 204, and so that it will not be accidentally actuated by a user's grasp around the device. Alternately, release button 219E may be a lower terminal portion of push bar 219.

Push bar 219 has a set of two metal or other material encircling guides, an upper push bar guide 219G, and a lower push bar guide 219H, both of which respectively have formed-in, vertically disposed, transverse endpieces, an upper fastening endpiece 219I and a lower fastening endpiece 219J, by which guides 219G, 219H are attached to spring mounting block 216 for support via a suitable adhesive placed into pressure-fit slots, respectively, upper endpiece slot 216A (not shown) and lower endpiece slot 216B (shown filled by endpieces 219I, 219J in FIG. 7), cut or preformed within mounting block 216. Alternately, endpieces 219I, 219J may be provided with further method of securement such as crosswise retaining pins set within block 216.

To gauge and limit the travel distance of push bar 219 within the ratchet assembly and between guides 219G, 219H, a suitably sized, right-angled push bar stop disk 219K is provided in the middle portion area of push bar 219 which stops when striking the bottom of upper guide 219G or the top of lower guide 219H. Thus push bar 219 is situated so that coil spring 219C biases push bar 219 to a downward position which places the lower face of stop disk 219K against the top of lower push bar guide 219H, and conversely stops push bar 219 from any upward travel once the upper face of stop disk 219K reaches the bottom of upper guide 219G.

Push bar 219 is positioned forward of spring bar 215E and between gears 217, 218 so that when push bar 219 travels upward or downward, its respective sets of teeth 219A, 219B will engage gear teeth sets 217C, 218C and urge gears 217, 218 to rotate. Thus as release button 219E is upwardly depressed, typically by a fingertip, connective push bar 219 travels upward. This action urges lower gear 217 to rotate in a counterclockwise manner, and urges upper gear 218 to rotate in a counterclockwise manner. This upward action also places push bar coil spring 219C in a higher state of tension. Thus, conversely, when coil spring 219C is free to release its tension, push bar 219 is urged to travel downward, lower gear 218 is urged to rotate in a clockwise manner, and upper gear 217 is urged to move in a clockwise manner.

When gears 217, 218 are made to rotate by the manual actuation of push bar 219, gears 217, 218 respectively engage gear teeth 215H, 215I on gear bars 215C, 215D. Thus as gears 217, 218 rotate clockwise (as viewed from the front) gear bars 215C, 215D will be urged to travel rearward (toward the right), and when gears 217, 218 rotate counterclockwise under the urging of spring 219C, gear bars 215C, 215D will be urged to travel forward. Since gear bars 215C, 215D are in a fixed relationship with pawl bar 215, whenever push bar 219 travels upward or downward, gears 217, 218 will urge gear bars 215C, 215D to urge pawl bar 215 with attached pawl teeth 215A, 215B to respectively engage into or disengage from ratchet gear teeth sets 212A, 213A.

Vertical ratchet pawl bar 215 is held in place within slide holes 204F, 204G by the urging interaction between spring bar 215E and helical spring 215G. Whenever pawl bar 215 is urged to travel rearward, connective helical spring 215G is compressed into a higher state of tension, and whenever pawl bar 215 is unconstrained, any stored tension in helical spring 215G urges pawl bar 215 with teeth 215A, 215B to travel forward and re-engage ratchet gear teeth 212A, 213A.

Whenever ratchet pawl bar 215 with teeth 215A, 215B is free to move, the shape and configuration of teeth 215A, 215B allows them to slidably pass over ratchet gear teeth 212A, 213A during a clockwise rotation of gears 217, 218. Thus the cooperative arrangement between ratchet pawl bar 215, spring bar 215E, and spring 215G allows ratchet pawl bar 215 to alternately move spring 215G into and out of a state of tension and to thus have a slightly springy forward and backward movement within slide holes 204F, 204G, and as well allows ratchet pawl bar 215 to have the possibility of a locked forward movement when engaging teeth 212A, 213A during any counterclockwise spool rotation.

Thus, from the above account, whenever release button 219E is manually depressed upwards, it urges push bar 219 to actuate the ratchet assembly in the aforementioned method and allow belt 207 to be freely unwound from spool 208, and whenever release button 219E is not depressed belt 207 may not be unwound from spool 208. The purpose of release button 219E is thus to effectively permit ratchet pawl bar 215 to disengage from gear teeth 212A, 213A to allow spool 208 to unwind counterclockwise to release belt 207, and then to swiftly capture belt 207 at a desired distance when release button 219E is no longer depressed. Thus, when release button 219E is actuated, insertion member 209 may be slowly or swiftly pulled away from left arm 203, thus increasing the tension of retractor coil spring 214A, which then increases its tension proportionately to the distance to which belt 207 is pulled outward. When belt 207 has been drawn out to a desired distance, release button 219E: is disengaged and urged to return to its rest position by the action of push bar return spring 219C. Ratchet pawl bar 215 will also respond to the spring action and be returned to a forward position to prevent any counterclockwise movement of spool 208, which will then only permit insertion member 209 and arm 203 to move toward each other incrementally with a ratcheted action. Release button 219E thus provides a manually-actuable method for controllably disengaging the spring-actuated ratchet-locking assembly. When belt tether 207 is being rewound on tether spool 208 by retractor spring 214A and the aforementioned incremental ratchet action is occurring, the slightly springy forward and backward movement of spring 215G will transfer through the mechanism and also cause push bar 219 to also have a slightly springy movement up and down.

Referring to FIGS. 7, 7A, 8, to prevent release button 219E from being further actuated, the ratchet assembly may be locked and unlocked utilizing a provided slidable, double-locking assembly, generally, 220. As shown in FIGS. 7, 7A, 8, a metal or composite double-lock button 220A is set and recessed into a suitably sized button hole 204L in the rear wall of right arm 204. Double-lock button 220A is slightly recessed both so that it may be easily located for actuation by a user's fingertip as it travels along the rear of right arm 204, and so that it will not be accidentally actuated by a user's grasp around the device.

Double-lock button 220A is at the rear end of a horizontally disposed, rearward-facing, metal or composite double-lock rod 220B which is suitably sized to be the same diameter as a standard handcuff key double-lock actuator push pin. The front end of double-lock rod 220B slidably engages a rearward portion of suitably sized push pin hole 204M in the frontal wall portion of left arm 204. When double-lock rod 220B is pushed forward by the act of depressing double-lock button 220A into hole 204M, the front portion of double-lock rod 220B slides against the rear portion (right side) of right-facing lower gear bar 215D and prevents gear bar 215D from further rearward travel, thus locking any further movement counterclockwise movement of ratchet gears 212, 213, and thus preventing push bar release button 219E from being actuated. Double-lock rod 220B is disengaged from the right side of lower gear bar 215D by the manual insertion of an extended pin handcuff key 222 (explained below) into push pin recess hole 204M which then pushes double-lock rod 220B front end rearward thus disengaging rod 220B from the right side of lower gear bar 215D and thereby unlocking double-lock button 220A for further use.

To guide double-lock rod 220B during its slidable travel, a suitably sized and positioned double-lock guide block 220C with a suitably sized and shaped double-lock rod guide hole 220D is provided between the front and rear walls of right arm 204 adjacent to spring mounting block 216. Hole 220D is suitably sized to provide sufficient friction against the length of rod 220B within hole 220D so that rod 220B will remain where positioned unless acted by an external force causing it to slide forward or rearward. Guide block 220C may be a formed part of the inner bottom material of right arm 204 along with spring mounting block 216, or be a suitably attached separate metal or composite member. To prevent accidental rearward slippage of double-lock button 220A out of entry hole 204L, a small suitably sized, metal or composite centered double-lock stop-disk 220E made of the same material as rod 220B is provided at a right angle to rod 220B and positioned adjacent to the front edge of guide block 220C. Stop disk 220E then acts as a travel stop between the front edge of guide block 220C and the rear edge of lower gear bar 215D, and thus also acts as a gauge for the travel distance for rod 220B to slidably lock and unlock the ratchet assembly.

FIG. 7B is a right side view of an extended pin handcuff key 222. FIG. 7C is a front view of FIG. 7B. FIG. 7D is a rear view of FIG. 7B. In order to properly operate double-lock assembly 220, the use of a an extended pin hand cuff key 222 with an extended pin 222C is required in order to properly reach into double-lock push pin hole 204M and push double-lock rod 220D away from its locked position against the front of lower gear bar 215I. Handcuff key 222 will also properly operate with all other conventional handcuffs with conventional keyholes sizings the size of handcuff pin holes 201F, 202F. Key 222 has a conventionally sized key barrel 222A, and a conventionally sized vertical barrel pin 222B, and a conventionally sized key ring retaining hole 222D.

Alternately, in lieu of double-lock button 220A as a method of pushing rod 220B to lock the ratcheting control assembly, a second opposing recess hole (not shown), which is suitably sized to be the same diameter as a standard handcuff key double-lock actuator push pin, may be provided at the double-lock button side of housing 204 directly opposite hole 204M.

Referring to FIGS. 9, 9A, 10, where FIG. 9 is a rear view of FIG. 3, and FIG. 9A is a left side view of FIG. 3, and FIG. 10 is a bottom view of FIG. 3, the two separate housing arms 203, 204 are shown connected together at the rear by a middle-positioned, vertical hinge assembly, generally 205, which has a left arm set of three rearwardly-protruding hinge pin collars 205A suitably sized to be enabled to be interlaced with a suitably sized right arm set of four rearwardly-protruding hinge pin collars 205B (reversed because of being shown from the back in FIG. 9). Hinge pin collar sets 205A, 205B are protruding, circularly-wrapped hinge pin retainers formed from the same material, respectively, as left arm 203 and right arm 204, and when fully, cooperatively interposed, are rotatably connective with each other by an inserted, force-fit, peened or capped metal hinge pin 205C which fits tightly within the circular apertures within the respective encircling collars. When hinge pin collar sets 205A, 205B are foldably rotated on hinge pin 205C, folded arms 203, 204 are substantially parallel in a back-to-back manner and appear as shown in top view in FIG. 11. FIG. 9B is a side view of the hinge assembly and locking plate control aperture configuration when the device of FIG. 3 is folded open. FIG. 9B also shows the relationship between upper and lower ratchet teeth 215A, 215B and their respective upper and lower receiving apertures 203D and 203E in spool enclosure right outside wall 203C.

When arms 203, 204 are unfolded from their position in FIGS. 9B, 11 to the rigid extension position of FIG. 9 by being rotatably extended by hinge 205 on hinge pin 205C so that arms 203, 204 are transversely aligned, a slidable locking bar 206 is manually slidably engaged within and between the rear inside walls of arms 203, 204 to rigidify the device. Slidable locking bar 206 is a metal or other material transverse bar which slidably travels within aligned suitably sized vertically disposed channels, a larger, left storage aperture 206A which runs transversely through left arm 203, and a lesser sized stopping slot, a right locking bar receiving aperture 206B in right arm 204 where locking bar 206 enters to rigidify the two arms into an integral unit (again, reversed because FIG. 9 shows the rear side of the device).

The left top end of bar 206 has an upper portion, a locking bar slide stop member 206D, which is a vertically extended and widened portion of the material of bar 206. Centered within slide stop member 206D is a vertically disposed, upward facing, recessed receiving aperture 206C suitably sized to receive the pin end of a standard handcuff key (or key 222 in FIG. 7B). When bar 206 travels through storage aperture 206A into receiving aperture 206B, slide stop member 206D causes the travel distance of locking bar 206 to be gauged and limited by the fixed slide distance of slide stop member 206D between the opposite vertically disposed ends of a transverse cutaway section 203F of left arm 203.

On the left side of cutaway section 203F is a truncated part 203G of left arm 203 which is top-cut to be approximately half the vertical length of slide stop member 206D to allow for the entry of a user's fingertip (typically, an index fingertip) to manually urge stop member 206D from the truncated part 203G of cutaway section 203F to its opposed end stop against the vertically cutaway material of left arm 203. When bar 206 is manually urged to travel through storage aperture 206A into receiving aperture 206B, it is thus limited to the transverse slide distance of slide stop member 206D between the opposing ends of cutaway section 203F.

Alternately, the preferred embodiment could also be provided with an internal or external transverse retaining clasp, or other type of retainer, and such a clasp or other retainer be made connective with an opposing spring-biased pin or bar-locking mechanism which would be matably, lockably unlockable by a standard handcuff key or other provided locking-unlocking mechanism.

Alternately, locking bar 206 could be otherwise positioned, configured or designed, for example, as a pivoting locking plate, or as a bottom-mounted, barrel bolt type of slidable locking device within the rear wall of left arm 203. And alternately, a slide stop member such as 206D could be otherwise designed with an internal stop member piece which would slide within a fixed distance, transverse slot within left arm 203. Alternately, a conventional double-plate hinge assembly may be utilized in lieu of hinge assembly 205 with the respective hinge plates being connected to a recessed, rear portion of arms 203, 204 and held thereto by a plurality of rivets or screws which are set into the inner wall material of the respective arms 203, 204 through a suitable set of provided screw holes within such hinge plates. Such alternate hinge plates would then be held rotatably together by a hinge pin such as hinge pin 205C and configured to be beneath lock bar 206.

Referring to FIGS. 9A, 11, when the rigidified device is to again be folded on hinge pin 205C, and bar 206 is to be withdrawn through apertures 206A, 206B, the user inserts the pin end of a standard handcuff key (not shown) into cutaway section 203F and thence into pin receiving aperture 206C and pulls bar 206 to the left urging it to slidably travel out of right arm receiving aperture 206B and back into its enclosed storage position in storage aperture 206A. As bar 206 reaches a point where its right terminus is slightly protruding from storage aperture 206A, slide stop member 206D strikes and stops at the left, truncated inside wall of cutaway section 203F. Bar 206 is left slightly protruding from storage aperture 206A to allow it to better engage receiving aperture 206B when the device is unfolded. If belt 207 is overly tight at the time folding is occurring, push bar release button 219E will be momentarily upwardly depressed to release pawl bar 215 and belt 207 as explained above.

As previously noted, CERI embodiments can be made either in a rigid or a foldable configuration, that is, so that they only remain in an integral rigid configuration, or so that they may be singly or multiply foldable where the assembly of individual sections are then unfolded and made integrally rigid. In those embodiments that are permanently rigid, the left and right sections can either be made in one piece or in two or more pieces which when assembled will remain integral and rigid during use as a restraining method.

In those embodiments that are foldable in half so that opposing restraints overlie each other, typically a flat hinge assembly such as hinge 205 or its mechanical equivalent will be used if the device is to be foldably rotated so that the back sides of opposing arms 203, 204 are to be folded back-to-back. However, if an embodiment is to be folded front-to-front, arms 203, 204 will be axle-pivoted from axle protrusions provided respectively at the top and bottom of spool enclosure 208A within respectively provided upper and lower extended spool enclosure covers which are respectively further provided with axle end retainers which rotatably capture such an alternate form of spool enclosure axle protrusions. A front-to-front spool-pivot rotationally foldable method is typically not utilized unless the width of arms 203, 204 is less than half the diameter of cylindrical spool enclosure 208A so that when the arms 203, 204 are folded they will confront each other in a substantially parallel manner. Alternately, any hinge or pivoting configuration may be utilized to make a CERI system device foldable.

Figure 13:
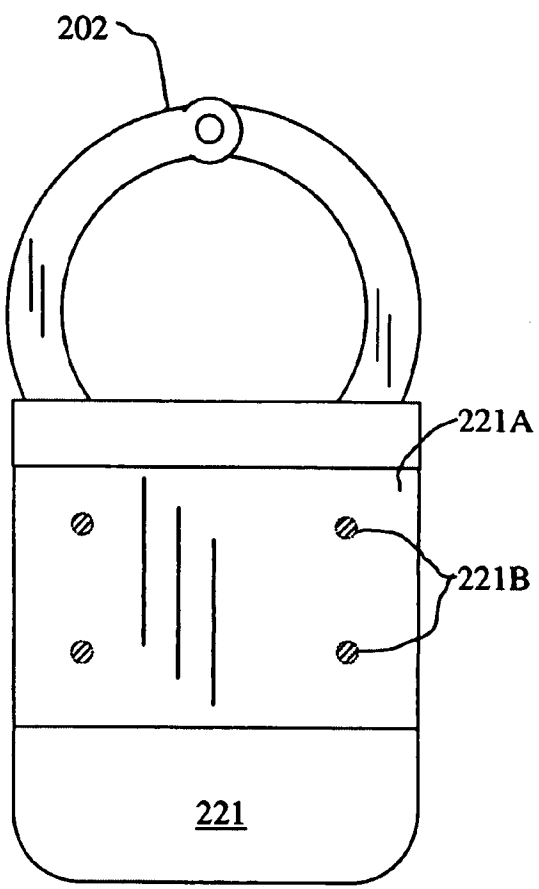
FIG. 13 is a rear view of the belt-carrying pouch of FIG. 12 showing the folded device within the pouch with its restraints upwardly vertically disposed and overlying each other.
Figure 12:
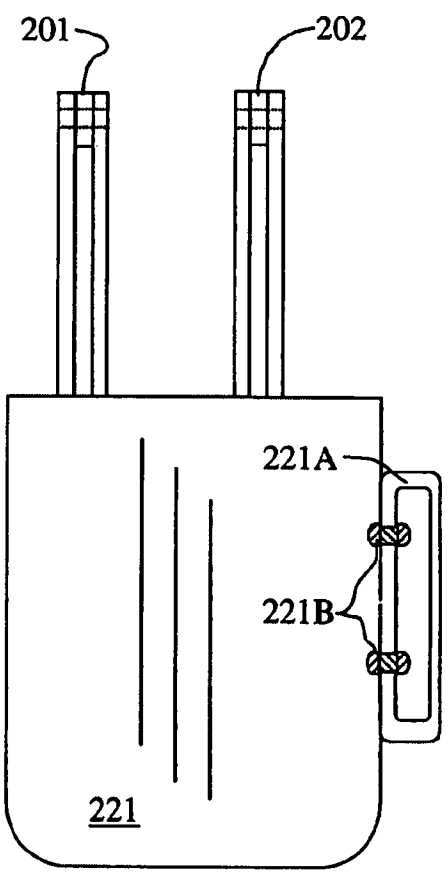
FIG. 12 is a right side view of a belt-carrying pouch for the folded device shown in FIG. 11 showing the folded device within the pouch with its restraints parallel and upwardly vertically disposed.

Typically, a CERI system using arcurate, swing-through handcuffs or the like, would be carried folded in half, cuffs-up, in a lined leather or a fabric carrying pouch appropriately sized for the particular CERI system, and fastened to an officer's belt rig using a typical belt loop method. FIGS. 12 and 13 respectively show a side and a rear view of such a carrying pouch 221 with the preferred embodiment of FIG. 3 inserted after having been folded in the manner of FIG. 11. A belt loop 221A is fastened to pouch 221 utilizing a set of conventional metal rivets 221B. Alternately, a carrying pouch such as pouch 221 as just described for FIGS. 12, 13, could be provided with a cover piece extending upward from the rear, or front or a side of the alternate pouch. Such a cover piece would be provided with a typical leather button snap assembly or a hook-and-loop clasping device. And alternately, a carrying pouch could be provided for portability on an officer's belt rig wherein the pouch is worn along a thigh with a hook-and-loop or otherwise connected side strap around the thigh and a carrying or support strap rising vertically to a clip to be placed on the officers belt rig. And alternately, the embodiment of FIGS. 3–13 could be made as a non-foldable rigid device with an integral housing rather than separately contained left and right arms. If made rigid, the arcurate wall 204D of the right arm and the right outside spool enclosure wall 203C of the left arm shown in FIGS. 7, 8 would not be present. A rigid embodiment of the device would be carried on an officer's belt rig in a more elongated embodiment of pouch 221 shown in FIGS. 12, 13.

Operation—FIGS. 3–13—Preferred Embodiment of the Invention

Basic Tactical Operation Without Tether Deployment

Law enforcement officials generally prefer restraint devices that can be rigidified for easier application and also be made foldable for easier carrying. The preferred embodiment of the CERI system described above has been designed so that it operates as either a rigid integral assembly for compliant subject arrest circumstances, or as a separated and extended set of restraints that may be utilized if a subject is resisting the application of the restraining device.

In order to make the device integrally rigid and yet foldable for easy carrying, the two opposing housing arms 203, 204 are provided with a rotatable assembly comprising a hinge 205 with a hinge pin 205, and a slidable locking bar 206, that allows left arm 203 and right arm 204 to be rotated with respect to each other on hinge pin 205C, so that arms 203, 204 may become either: a. rigidly, linearly, transversely aligned, and then slide-locked into a rigidified position by manually pushing locking bar slide stop member 206D, typically with an index fingertip, to urge connective slidable locking bar 206 into right aperture 206B, as shown in FIGS. 3, 4; or, b. folded so that respective arms 203, 204 are substantially parallel, and so that restraints 201, 202 overlie each other, as shown in FIG. 11. Procedurally, when arms 203, 204 are to be again manually unfolded from their position in FIG. 3 to the folded position of FIGS. 9A, 11, locking bar 206 is disengaged by inserting a handcuff pin into pin aperture 206C within bar 206, and then manually urging bar 206 to slidably travel out of right bar aperture 206B until slide stop member 206D brings bar 206 to a secure rest position. If belt 207 is overly tight at the time folding is occurring, push bar release button 219E will be momentarily upwardly depressed to release pawl bar 215 and belt 207 to allow the device to be manually folded on hinge pin 205C until arms 203, 204 are again substantially parallel. In the rigidified position of FIGS. 3, 4, the device is operated using the same methods as would be utilized for conventional unfolded and rigidified hinged handcuffs, unless the decision is made to deploy belt tether 207, as will be explained more fully below.

A typical hand grasp of the rigidified device when approaching a compliant subject would utilize the web of an index finger and thumb (not shown) to grasp around spool enclosure 208A from the side, or to grasp over spool enclosure 208A with the palm resting on top of spool enclosure 208A. In either grasp, the middle, ring, and little finger (not shown) will be downwardly disposed and able to reach around the back side and bottom of the device. In a right-handed operation, this will position the right-hand fingers to face toward the left, with the thumb to the front and the other fingers to the rear side of the device reaching down and around the bottom of the device. A left-handed operation would be oppositely positioned. A preferred hand grasp may also depend on the particular CERI embodiment's spool size and housing dimensions, as these will vary according to the differing embodiments. For example, a lesser or greater length belt tether 207 will require a lesser or greater sized spool 208, and spool size will as well depend on the thickness of the belt material utilized in the embodiment. Similarly, in alternate embodiments, the sizing of a ratcheting control assembly and/or hinge method may result in a smaller or larger overall size for housing arms 203, 204.

The sizing of the detainer's hand, large, medium or small, should be irrelevant when grasping the CERI device shown and described in terms of FIGS. 3–11. This is so because the device would typically be made with a shorter tether length and so with a spool enclosure sufficiently reduced in size for a small hand to grasp the device securely, and yet provide the device with sufficient surface area for a reach-around method for a medium or larger hand. Irrespective of the detainer's hand size, if the detainee becomes non-compliant and the detainer chooses to deploy belt tether 207, the two finger-actuated control buttons, release button 219E and double-lock button 220A, are easily within finger reach and easily finger-actuated.

When approaching a subject who appears to be of average size and compliant with the officer's orders or directions, the detainer officer will, as aforementioned, use conventional handcuffing methods to apply handcuffs 201, 202 and then double-lock the cuffs as was previously explained using the pin end of a standard-sized handcuff key inserted into push pin holes 201F, 202F. To avoid further security problems, the officer will also double-lock belt tether 207 by inwardly depressing double-lock button 220A to actuate double-lock rod 220B to lock lower gear bar 215D in place to prevent the subject from possibly depressing release button 219E and extending belt tether 207. In an ideal compliant detainment scenario, the officer will maintain the restraints on an arrestee until arrival at a secure detention facility, and thereafter remove the restraints or otherwise secure the subject. When the restraint portion of the arrest is completed and the CERI device is to be placed into storage containment in carrying pouch 221 or be otherwise stored, the device would typically be again folded on hinge pin 205C after bar 206 is withdrawn through apertures 206A, 206B as was just explained above.

Referring to FIGS. 12, 13, the CERI system will typically be worn on an officer's belt rig and carried in a pouch similar to carrying pouch 221. Typically, carrying pouch 221 will be carried to the front left or front right strong side of a detainer with cuffs 201, 202 pointing upward for easy withdrawal from the pouch. Alternately, the CERI cuffs can be worn folded and draped through the detainer's belt, or be carried cuffs-up from the belt rig via a draped strapping method.

Basic Tactical Operation with Tether Deployed

To operate the apparatus of the preferred embodiment of the CERI system using a tether deployment method in an attempt to restrain either a larger-sized subject and/or a subject who is potentially non-compliant to the officer's verbal orders or directions, the detainer officer will begin by grasping the device as explained above. If a rear approach to the subject can be made with the intent of handcuffing the subject behind his back, in terms of a right-handed officer, the officer's initial objective will be to handcuff the subject's left wrist with left handcuff 201. The reason for this is so that if tether deployment is likely, it is easier for a right-handed officer to pull the device away to the right from a secured left wrist since this will allow the officer to maintain finger control over control buttons 219E and 220A. A left-handed officer may choose to first cuff the subject's right hand so that his potential tether deployment results in a pull to the left and so that his left-hand fingers maintain control over control buttons 219E and 220A.

Belt tether 207 is never deployed before tethered left cuff 201 is fully secured to a wrist (or ankle, etc.) so that there is no chance that retractor spring 214A will suddenly retract tether 207 with tethered cuff 201 and strike the officer. Similarly, an officer never positions a grasping hand over the device so that any portion of the hand extends beyond left arm 203 so that in the event of an accidental recoil the officer will not be struck by a moving part. An officer should also be aware that if he releases right arm 204 from his grasp while tether 207 is deployed, that retractor spring 214A will urge tether 207 to retract and thus urge the device toward tethered cuff 201.

As previously stated, when a CERI device is rigidly extended as shown in FIGS. 3, 4, 7–10, insertion member 209 with its associated connective restraint, here, left handcuff 201, can be made to separate from the main body of the device with its associated connective restraint, here, right handcuff 202, in a controllably extendible method along the line of belt tether 207 as shown in FIGS. 5, 6. Referring to FIGS. 3, 4, and 7, 8, the controllable separation is performed by the officer in a right-handed manner after applying left restraint 201 to the subject's left wrist, and while grasping the middle or right portion of the rigidified device with the officer's right hand (not shown) in a palm-down, over-the-top positioning, with the officer being ready to use his right hand to pull the device to the right. In this position, the fingertips of the officer's right hand will be curled beneath the device so that either the middle, ring or little finger (not shown) will be in a position to be manipulated so that a curled fingertip may engage and upwardly depress recessed release button 219E and then hold button 219E upwards against the tension of coil spring 219C into retaining aperture 204J. As the ratchet assembly then actuates pawl bar 215 to disengage from gears 212, 213, belt tether 207 will be freed to be extracted from spool 208 when the officer's right hand pulls the device to the right.

The officer or other detainer will then use his left hand to brace the subject's left arm as the officer initiates a pull of the device to the right while release button 219E is upwardly depressed. As the device moves outward, belt tether 207 will unwind between the subject's left wrist and the officer's right hand. If a left-handed operation is used, the description above would be hand-reversed.

When the officer has brought belt tether 207 out to a sufficient distance, he will release button 219E. When release button 219E is no longer held upward, coil spring 219C will return button 219E to its normal rest position and pawl bar 215 will re-engage gears 212, 213 and belt tether 207 will no longer be able to be pulled outward. Concurrently, retractor spring 214A, raised to higher state of tension in proportion to the outward extraction distance of belt tether 207, will be set to urge belt 207 to rewind around spool 208 when no further outward urging force is applied, thereby setting up mechanical conditions for bringing insertion member 209 with attached left restraint 201 to again come to rest within docking channel 210.

Once the officer has applied left swing-through cuff 201 to the subject's left wrist until it is ratchet-locked, and deployed belt tether 207 as described above, the officer will then remove his left hand from the subject's cuffed left hand. The officer's left hand will then be moved to grasp the subject's right arm or hand. The officer will then use his right hand, preferably, to position extended right cuff 202 to the inside (left side) of the subject's wrist and then apply right cuff 202 to the subject's right wrist. Once the right wrist of the subject is engaged by right cuff 202 it will be tethered to the opposite left cuff 201 along the line of tether 207. At this point any attempted movement of the subject's arms away from each other will result in the previously described activation of the ratcheting mechanism. And any movement of the subject's arms toward each other will result in the activation of retractor spring 214A as it urges belt tether 207 to rewind back around spool 208. Other less preferable right-cuffing methods are considered below.

If the subject does not then willfully comply in moving his wrists together and allow belt tether 207 to rewind until insertion member 209 reaches either a flush and rigid connection with docking channel 210, or a reasonably close separation distance, the officer will then begin to either compel the subject's arms or legs together, or continue to impel the subject off-balance so that the subject's own movements cause retractor spring 214A to activate and so cause belt tether 207 to unidirectionally rewind on to spool 208 and also prevent the subject from further separating opposing cuffs 201, 202.

Or again, as an arresting officer or other detainer attempts to control a subject, or uses other measures to cause a subject's arms to come together, each slight movement of insertion member 209 toward left arm 203 will result in an action by retractor spring 214A to rewind belt tether 207, and each attempt by the subject to force his arms and hands apart will be met with the overpowering resistance of ratchet pawl teeth 215A, 215B falling incrementally into successive ratchet teeth 212A, 213A in ratchet gears 212, 213 preventing spool 208 and so belt tether 207 from further unwinding. As the officer continues in small or large increments to bring the subject's opposing arms toward a central position behind the subject's back, insertion member 209 will eventually be ratcheted back either flush and rigid with docking channel 210, or insertion member 209 will be stopped at a reasonable distance for a larger-sized subject where belt 207's distance will then be held in place by the ratchet mechanism.

Once the detainer has managed to bring the subject's two cuffed hands together so that insertion member 209 has either been rigidly secured within docking channel 210, or stopped at a comfortable distance for the subject's size, and handcuffs 201, 202 have been double-locked as previously explained using the pin end of a standard sized handcuff key inserted into push pin holes 201F, 202F, double-lock button 220A may then be inwardly depressed to actuate double-lock rod 220B to lock lower gear bar 215D in place to prevent the arrested subject from possibly depressing release button 219E and further extending belt tether 207.

Once the subject has been transported to the processing room, if he is yet unruly, the officer may choose to only remove right restraint 202 and place the removed restraint in connection with a fixed post retainer or a pre-positioned wall anchor such as a typical processing room eyehook device. The officer can then selectively control the distance which he will permit for radial movement of the subject about the retaining pivot point of connection depending on the tether length provided in the controllably extendible restraint interconnection. Alternately, the officer may release one handcuff and place belt tether 207 around an object such as a pole or pipe, and then reattach the second cuff to keep the subject in one location. To better secure the subject, the tether could be cross-wrapped around the pole or pipe and then ratchet-locked at a close distance to the object.

Alternate Circumstances of Use Guidelines

As noted above, when belt tether 207 is extended, it could allow for an easier takedown of a difficult subject. Part of that easier takedown is owing to the extended reach provided by belt tether 207, but equally important is the fact that the extended right cuff 202 can be manipulated into any orientation required to capture the subject's right wrist. Since belt tether 207 is flexible and supple, and can be bent, twisted, or folded without breaking, cracking, etc., it is possible to re-orientate right cuff 202 for a cuffing procedure far more easily than is possible to orientate conventional chain-linked or rigidified cuff embodiments. The controllable extension of belt tether 207 between restraints 201, 202 also allows an officer a "working zone" wherein he may better apply right cuff 202 to an as yet uncuffed wrist.

Occasionally, a subject will attempt to "spin out" from the restraint situation after one cuff is applied. If this occurs, an officer will typically have one of several options to resolve the situation: a. the officer can work his way down the belt tether from the officer-held right side cuff 202 toward tethered cuff 201 and then use right cuff 202 to torque against the subject's wrist area to cause momentary pain compliance and thus control the subject as he would normally do when the device is rigidified; or, b. the officer can let go of right cuff 202 and allow the CERI device to retract back toward left cuff 201 so that the subject has the CERI device in his possession, but attached to his left wrist, and then escalate the use of force to regain control over the subject; or, c. the officer can quickly double-lock the CERI device using double-lock button 220A and grasp right cuff 202 in an attempt to pull the subject back toward the officer; or, d. the officer can attempt to rotate belt tether 207 around the officer's body to impel the subject off balance while extending a leg to trip the subject and possibly relocate him to the ground; or, e. the officer can fasten unsecured cuff 202 to a fixed object and then act to regain control over the subject. In an alternate negative scenario, when an unruly subject pulls completely away from the officer after one cuff is applied and the subject has the CERI device still attached and free-wheeling, unless the subject hold restraints 201, 202 apart, the retractor assembly will retract belt tether 207 and be ratchet-locked at his left-cuffed wrist. At this point the officer would be required to proceed to the next level of force to regain control over the device.

Generally speaking, the most efficient tether length for a takedown from behind is approximately 45.7 mm (18") as measured left cuff 201 center to right cuff 202 center. At this distance the subject's arms can be effectively urged together behind him without the potential problems incurred with a greater distance. At this distance an average-sized, rear-cuffed subject cannot raise belt tether 207 from behind to a point over his head in an attempt to move the cuffs to his front. This makes it more difficult for him to attempt a "step through" of belt 207 to bring restraints 201, 202 in front of his body. As well, a minimal belt tether 207 use length reduces the possibility of a loss of control over the subject and belt tether 207 as well.

To follow is an alternate form of front cuffing, utilizing a CERI device with a sufficiently long belt tether 207, in terms of a right-handed officer. If a compliant subject is to be cuffed in front, the officer will face him (or her) and have the subject cross his forearms one over the other. He will then and apply left cuff 201 to the subject's crossed left wrist. Belt tether 207 will be extended as previously described, and the officer will have the subject slightly raise his crossed forearms. The officer will then weave right cuff 202 with the trailing belt tether 207 under the subject's left armpit, and then wrap right cuff 202 and belt tether 207 around his upper back, and then thread them back through the subject's left armpit area toward his front. The officer will then place right cuff 202 on the subject's left wrist. As the subject again lowers his forearms to a rest position against his chest the retractor mechanism in the device will shorten the belt tether 207 until it is relatively tight around the subject's backside. This positioning of belt tether 207 will then keep the subject's forearms comfortably crossed, but unable to be moved outward or over his head. The ratchet assembly will then be double-locked by depressing double-lock button 220A. If the officer is left-handed, he will use his opposite hands in the above account of operation.

Insertion member 209 is designed symmetrically so that it may enter docking channel 210 even if inverted. Thus, in a situation where an officer unintentionally applies one of the two handcuffs in an inverted manner, insertion member 209 will still engage docking channel 210 so long as belt tether 207 is not multiply twisted forming a block to entrance. However, even if this occurs, insertion member 209 may be stopped short of docking channel 210 and the ratchet assembly within the device will still prevent the two opposing handcuffs from separating further. Thus, if alignment during closure is not a possibility due to the difficulty of a takedown struggle, rather than forcing himself to the point of exhaustion, the officer may choose to leave insertion member 209 external to docking channel 210 and simply double-lock the ratcheting control assembly by using double-lock button 220A to prevent arrestee escape. Although it is unlikely that a handcuffed subject could reach release button 219E in an attempt to extract belt tether 207, if the double-lock device is utilized, release button 219E will not be depressible.

Compliant and non-compliant takedown situations may arise in various handcuffing positions: wall, free-standing, prone, kneeling, hands in front, hands on top of head, hands behind back, and hands behind head. Resisting generally starts prior to handcuffing or at the application of the first cuff. Handcuffs should not typically be deployed until the subject is stable, however an arrestee may appear stable and then suddenly become unruly. The two positions that are the more difficult are the hands on top of head and behind the head, because they respectively require more movement of the arms to bring the wrists together. Generally, when one cuff is applied, and the cuffed arm is moved to the small of the back to met the other arm, in principle, if the subject begins to resist the application of the restraining device, an officer can then apply an arm bar or a tactical maneuver which will relocate the subject to the ground or floor. Most subjects who resist the application of the restraining device end up on the ground or floor, which is where a CERI system is most beneficial to the officer. When an officer is on top of a prone subject, the officer is typically attempting to drag, push or pull the subject's arms to restrain the subject. With a tethered cuffing system, less actual movement is required to reach the subject's extended, uncuffed wrist, and then cuff that wrist and bring it toward the opposing restraint via the CERI ratcheting system. Additionally, in this ground-based positioning, an officer has the benefit of greater strength and leverage when his arms are closer to his body, and less as his arms move further away from his body.

As with any handcuffing method of unruly subjects, various foreseeable problems can also arise during the utilization of a tethered belt or cable system. For example, it is possible during an attempted cuffing procedure of an unruly subject to inadvertently pass the tether around a movable or a fixed object, or have a subject move an unrestrained arm outward or upward to a point further out than the current extension of the tether, or have a have an arrestee who seems to stop resisting and then suddenly pulls away in the same direction that the officer is pushing, or have an arrestee who attempts to strike or grab at anyone around him, or who does not begin to become unruly until he is being uncuffed, or who attempts any number of various negative actions. Because these problems are foreseeable, they can be effectively dealt with when officers are trained in the use of the CERI method.

A temporary loss of control by an officer during handcuffing or restraint application using a CERI method could involve a number of foreseeable negative scenarios other than those already mentioned. For example, if a cuffed detainee attempted to prevent tether retraction by holding the belt 207 in a fixed distance position, the solution to regaining control could possibly be to move the arm of the subject that can best be levered to move toward the opposing arm to utilize the retractor mechanism. Oppositely, if a subject was attempting to ensnare the officer in an overly extended tether, an officer could respond either by grasping belt 207 in an attempt to wrench it away from the subject, or he could release the CERI device and move to the next level of force to gain compliance. Or, for example, if after the tethered cuff was applied, a subject was attempting to wrench the device away from an officer in order to begin flailing around the unsecured cuff housing, the officer could again be required to move to the next level of force. An upward change of force levels is not owing to any particular fault with the use of the CERI device, but would equally apply to any difficult takedown procedure. When a CERI device is offered for use, it will most likely be accompanied by a basic training manual for use of the CERI system which illustrates and explains the various counter moves that would typically be utilized to defeat the aforementioned and other negative scenarios, and to better define procedural methods of operation, and thus increase officer confidence in the use of the CERI method.

The operational objective of any Controllably Extendible Restraint Interconnection system, or CERI system device is to provide a restraint system that works as effectively as conventional restraints under ideal circumstances, and which will as well operate more effectively, and not mechanically fail, or be awkward or impossible to use under difficult arrest circumstances when the restraints have been controllably extended. With the proper mindset and training environment, a CERI system can provide a safer and more secure way to effectively restraint unruly subjects as well as perform equivalently to more traditional restraint methods.

Alternately, a CERI device as is, or as otherwise modified, could be utilized operationally by a street officer in a variety of ways. For example, to keep a subject temporarily fixed in one location, a subject could be stood face-side or back-side next to a pole, tree or other fixed object, and belt tether 207 passed around the fixed object before being attached to the other wrist or ankle. Or, the device itself could be connected either to two fixed objects, or to itself around a tree or pole, and belt tether 207 utilized for securing multiple arrestees by loop straps around the tether to temporarily keep multiple subjects in one place. The device could also be utilized under extenuating circumstances to assist in carrying an injured person, or to tether two objects together, or to suspend a load on a tether, or could be cuffed to itself to provide a looping belt for securing objects together.

Description—FIGS. 14, 15—Alternate Embodiment

As previously noted, for the purposes of the specification, although the preferred embodiment has been specified in terms of a "belt tether," the term "tether" as used herein to describe and claim the present invention should be understood (with explained modifications) to cover tether members having cross sectional shapes other than flat, and may include circular or other shapes such as would describe cords, cables, or other flexible interconnections between restraints.

FIG. 14 is a front, transversely centralized, cross sectional view of an alternate embodiment of the restraint interconnection device of the present invention wherein a cord or cable tether 307 is utilized as a tethering method. FIG. 15 is a top sectional view of the alternate embodiment of FIG. 14 taken along lines 15—15 of FIG. 14. The alternate embodiment of FIGS. 14, 15 also exemplifies a CERI system wherein an attachably-detachable restraint retaining method has been utilized (as opposed to the fixed-attachment restraint retaining method of FIGS. 3–11) in conjunction with an integral, metal or composite central housing 300 which houses a vertically disposed cable spool 308 and a ratchet assembly. Central housing 300 has an oval-shaped body, a flat top panel 300A, and a parallel flat bottom panel 300B. Typically, top and bottom panels 300A, 300B are screwed onto the oval body portion of housing 300 for removal for repair and cleaning (not shown). Central housing 300 is suitably sized to be graspable by an average-sized user's hand.

Referring to FIGS. 14, 15, a diagrammatic set of restraints, generally, a left releasably-lockable loop restraint 301, and a right releasably-lockable loop restraint 302, have been shown to exemplify any conventional form of restraint, such as handcuffs, manacles, etc., which may be utilized with the alternate embodiment. In the alternate embodiment, in lieu of a fixed-restraint connection method such as was shown for the preferred embodiment, an attachably-detachable, restraint-retaining buckling method is utilized. A metal or composite left buckle housing 303 and a right buckle housing 304 are provided on the respective outside ends of central housing 300. The right central wall of left buckle housing 303 is provided with a hardened metal left connector link 303B either by forming link 303B into the material of left buckle housing 303, or by utilizing a separate link affixed by conventional link-fastening methods. Left connector link 303B is fastened on its right to an end of a metal cable or Kevlar™ cord, or its equivalent, a cable tether 307, at a terminal cable tether loop, either by utilizing a manufactured ring-shaped endpiece 307A or by other cable attachment methods such as a ferrule and stop.

The left central wall of right buckle housing 304 is provided with a hardened metal right connector link 304B either by forming link 304A into the material of right buckle housing 304, or by utilizing a separate link affixed by conventional link-fastening methods. Right connector link 304B is fastened on its left to a right wall of housing 300 by utilizing a hardened metal, cross braced, link-retaining bar 304C which passes horizontally through a suitably sized slot 300C in the right wall portions of housing 300. Link 304A is contained within a suitably sized vertical wall slot 300D at the right end of housing 300, and held therein by retaining bar 305 which is suitably sized to be force-fitted through slot 300C while being tightly passed through link 304A.

Buckle housings 303, 304 respectively have a slotted aperture on their outside ends, a left buckle receiving slot 303C, and a right buckle receiving slot 304C, suitably positioned and sized to receive a set of metal or composite, elongated, attachably-detachable restraint buckle tongues, respectively a left restraint buckle tongue 303A, and a right restraint buckle tongue 304A, each suitably sized to slidably fit tightly within receiving slots 303C, 304C. Tongues 303A, 304A are either a formed part of, or suitably affixed to the inward-facing sides of a left loop restraint-retaining member 301A, and a right loop restraint-retaining member 302A, and respectively have latch-bar receiving holes, a left buckle tongue latch-bar receiving hole 303D and a right buckle tongue latch-bar receiving hole 304D. Restraint-retaining members 301A, 302A are then respectively connected at their outward-facing sides to a left and a right releasably-lockable, typically integral loop restraint, generally 301, 302, and are either a formed part of, or suitably affixed to, or suitably clamped around, that portion of loops 301, 302 which face toward the respective outside ends of buckle housings 303, 304.

Loop restraints 301, 302 are typically integral restraining devices which when affixed to retaining members 301A, 302A (as explained above) respectively have a pair of elongated loop arms, an upper-left loop arm 301B, and a lower-left loop arm 301C, and a upper-right loop arm 302B, and a lower-right loop arm 302C, with each respective set of loop arms disposed in a partial circle manner toward each other as they respectively outwardly extend from retaining members 301A, 302A. Loop restraints 301, 302 are suitably sized to be enable to fully encircle a larger-sized human wrist or ankle.

Loop restraints 301, 302 respectively have transverse teeth on one side (not shown) which slidably engage with a left releasably-lockable detent 301D, and a right releasably-lockable detent 302D which are respectively provided for loop restraints 301, 302 typically at the terminus of upper loops 301B, 302B. Such releasably-lockable restraints as 301, 302 utilizing releasably-lockable detents such as 301D, 302D are fully explained in U.S. Pat. No. 3,991,444, Nov. 16, 1976, Releasable Cable Tie, to Michael S. Bailey, Palos Hills, Ill., and are licensed to and available from Panduit Corporation, Tinley Park, Ill. Any other conventional loop type of releasably-lockable restraint or detent may also be utilized in lieu of restraints 301, 302 or detents 301D, 302D.

When buckle tongues 303A, 304A are respectively passed through left receiving slot 303C and right receiving slot 304C in respective buckle housings 303A, 304A, their respective reception into slots 303C, 304C is stopped by downwardly disposed spring-biased latch bars, a left cylindrical spring-biased latch bar 311B, and a right cylindrical spring-biased latch bar 312B in respective buckle housings 303A, 304A which are respectively downwardly spring-biased by a set of latch coil springs 311E, 312E (as properly explained below), which urge latch bars 311B, 312B to travel through buckle tongue holes 303D, 304D, thereby locking the respective tongues within their respective housings.

Left buckle housing 303 contains a left lower mounting block 309A which is a formed part of housing 303, or is attached therein as a metal or composite form-fitting block. Block 309A has a left vertically disposed, cylindrical aperture 309B which is suitably sized to accommodate a vertically disposed, left-slotted slide tube 309C suitably sized to accommodate a handcuff pin-sized left slidable cylindrical rod 311. Tube 309C is slotted vertically on its right side and accommodates a left-slidable cross bar 311A which is formed into rod 311 or attached at a right-facing right angle to rod 311. Cross bar 311A is formed into or attached to cylindrical left spring-biased latch bar 311B. Left latch bar 311B is contained at its upper end within a vertically disposed, left latch bar slide tube 311C which contains a left latch coil spring 311E above latch bar 311B. Directly below latch bar 311B, within block 309A, is a cylindrical, left-receiving aperture 311D for a lower portion of latch bar 311B.

In order to introduce left buckle tongue 303A into buckle housing 303, the user inserts the pin end of a handcuff key (not shown) into the lower end of tube 309C and pushes rod 311 upward. Connective cross bar 311A is then carried upward along with connective latch bar 311B and forces spring 311C upwards into a higher state of tension. Buckle tongue 303A is then inserted while latch bar 311B is held in an upward position. Buckle tongue 303A has a provided left, circular latch aperture 303D which then aligns below the travel path of latch bar 311B. When buckle tongue 303A is fully inserted into receiving slot 303C, the handcuff pin is withdrawn from tube 309C and coil spring 311C urges latch bar 311B (along with cross bar 311A and rod 311) to travel downward, and latch bar 311B enters into mounting-block receiving aperture 311D and latches buckle tongue 303A in place within buckle housing 303.

Right buckle housing 304 contains equivalent and oppositely configured components, being a right-lower mounting block 310A, a right-vertically disposed, cylindrical aperture 310B, a right-slotted slide tube 310C, a right-slidable cylindrical rod 312, a right-slidable cross bar 312A, a right spring-biased latch bar 312B, a right latch bar slide tube 312C, a right latch-bar receiving aperture 312D, and a right coil spring 312E, all of which components interact and operate in the same manner as described for left buckle housing 303. Right buckle tongue 304A is then introduced into right buckle housing 304 using the same method described for the insertion of left buckle tongue 303.

Cable tether 307 is threaded through a reeling aperture 307B formed or drilled into the left center of central housing 300, and thence passes into housing 300 where it is reeled onto a metal or plastic composite cable tether spool 308 and is wound tightly about cable tether spool 308 in a clockwise direction when viewed from the top. Spool 308 is mounted onto a cylindrical metal vertical axle 308A which is held in place at its top by a recessed internally cylindrical metal axle housing 308B suitably sized to accommodate the top of axle 308A. Axle housing 308B is form-fit into the upper inside material portion of central housing 300. The bottom portion of axle 308B is rectangular shaped (not shown) and sized to fit within a rectangular receptacle (not shown) within an external metal or plastic retractor spring enclosure 313. Alternately, an internal winding spring method within spool 308 may be utilized.

Retractor spring enclosure 313 has a conventional coil retractor spring 313A which is relaxed when cable tether 307 has been wound tight during a clockwise rotation of axle 308A. As stated, in FIGS. 14, 15 cable tether 307 is considered to have been wound around spool 308 when spool 308 was turned in a clockwise direction if viewed from above, and thus spring 313A is in a relaxed state in FIGS. 14, 15. If cable tether 307 is then pulled outward to unwind from spool 308, spool 308 turns counterclockwise to unwind cable tether 307 and thus will wind coil retractor spring 313A within retractor spring enclosure 313 to a state of higher spring tension.

Retractor spring enclosure 313 is rectangularly shaped on the outside and slides into an appropriately sized receptacle slot 300E in the inside base material of housing 300. When retractor enclosure 313 is properly seated within the base material it cannot rotate or otherwise move when winding tension is applied to spool 308 and axle 308A as cable tether 307 is pulled from spool 308. Alternately, retractor spring 313A can be replaced by an electrically motorized retractor with a suitably connected power source, such as a battery, and appropriate electric connections and switchwork.

The top plate portion of spool 308 is made in the form of a circular, hardened metal or resin composite ratchet gear 314 which rotates with spool 308 and axle 308A. A hardened metal or resin composite ratchet slide-and-stop tooth 315A is formed into or connective with the rearward portion of a metal or resin composite vertical ratchet pawl bar 315 with a protruding pawl tooth 315A. Pawl tooth 315A is sized and positioned with respect to ratchet gear teeth 314A to either allow ratchet teeth 314A to slide past tooth 315A during a clockwise rotation, or to engage ratchet gear teeth 314A whenever spool 308 and axle 308A are induced to attempt a counterclockwise rotation.

Vertical ratchet pawl bar 315 has a mounting hole 315B sized to accommodate (and shown filled by) a ratchet pawl bar axle 315C. Vertical ratchet pawl bar 315 is held in place at its bottom by a metal or other material ratchet pawl bar mounting block 316. Block 316 has a vertical slot 316A (not shown) suitably sized to accommodate the insertion of the bottom of bar 315, and also has two opposing holes, a front hole 316B, and a rear hole 316C (not shown) on either side of slot 316A (not shown) sized to accommodate bar axle 315C.

When the bottom of ratchet pawl bar 315 is inserted into slot 316A (not shown) in block 316, axle 315C fits snugly through holes 316B, 316C and less snugly through hole 315B in the bottom of ratchet pawl bar 315. This arrangement allows ratchet pawl bar 315 to have a slight forward and backward movement on axle 315C whenever top pawl tooth 315A is sliding past ratchet teeth 314A during a counterclockwise rotation of gear 314, and to have the possibility of a forward movement when engaging teeth 314A during any clockwise spool rotation.

At the back side of ratchet pawl bar 315 is a tension block 317 made of a rubber-like springy substance. Tension block 317 contains a vertically disposed metal or other material brace bar 317A which has been pressure fit into a tension block mounting slot 317B (not shown; filled by 317A) within block 317's lower middle section. Brace bar 317A then passes downward into a pressure fit with a lower brace bar mounting slot 317C (not shown; filled by 317A) set within a rear material portion of pawl bar mounting block 316. Brace bar 317A prevents tension block 317 from any movement from its preset position within housing 300.

Tension block 317 is positioned between the back side of ratchet pawl bar 315 and the inside portion of the right side of housing 300. Tension block 317 forces ratchet pawl bar 315 and its top ratchet tooth 315A forward so that tooth 315A engages gear teeth 314A and thus forces spool 308 into a locked position whenever a clockwise rotation of spool 308 is attempted. Whenever a counterclockwise rotation of spool 308 occurs, gear teeth 314A touch against the slide portion of ratchet tooth 315A and induce tension block 317 to momentarily compress as each of ratchet teeth 314A slidably passes over ratchet tooth 315A.

A ratchet pawl bar top end 315D has screw threads which extend to a slight distance through and above a top slot 300F in the top of housing 300. A metal or composite screw-on knurled cap 315E is then affixed to ratchet pawl bar top 315D. The screw threads are utilized to tighten cap 315E to top panel 300A of housing 300 in order to prevent ratchet pawl bar 315 from moving from a chosen position of ratchet engagement or disengagement. Top slot 300F is sized so that pawl bar 315 may be moved a sufficient distance to the right to permit ratchet tooth 315A to disengage from gear teeth 314A to allow spool 308 to unwind clockwise to release cable tether 307.

Thus, if lateral pressure is applied to the right against ratchet pawl bar cap 315E, this will move ratchet pawl bar 315 to compress tension block 317 and move ratchet tooth 315A away from any connection with ratchet teeth 314A. This action will then permit cable tether 307 to be pulled away from housing 300, thus increasing the tension of retractor spring 313A, which then increases its tension proportionately to the distance to which cable tether 307 is pulled outward. Top slot 300F also has the function of preventing any side-shifting movement of ratchet pawl bar 315 during a situation where cable tether 307 is being pulled against the pressure of pawl bar 315 when it is engaged in gear 314.

When cap 315E is then loosened (unscrewed), tension block 317 will restore itself to its previous non-deformed state and push pawl bar 315 forward causing tooth 315A to re-engage ratchet teeth 314A and so lock gear 314, spool 308 and the drawn out cable tether 307 at that length. If cap 315E is again pushed to the right, retractor spring 313A will exert its stored tension and begin to recoil and cause axle 308A with spool 308 to rotate clockwise and so rewind cable tether 307 back onto spool 308 and bring cable tether 307 back to its rest position against the left side of housing 300.

When cable tether 307 has been withdraw from housing 300 to a desired length in the manner just described, and when both loop restraints 301, 302 have been applied to a subject unwilling to bring his cuffed hands together, the tension in retractor spring 313A will not be sufficient to rewind cable tether 307 into housing 300. However, as the arresting officer attempts to compel the subject's arms together, each slight movement of cable tether 307 toward housing 300 will result in an action by retractor spring 313A to incrementally rewind cable tether 307, and each attempt by the subject to propel his arms and hands apart will be met with the overpowering resistance of ratchet tooth 315A falling into successive ratchet teeth 314A in ratchet gear 315 preventing cable tether 307 from unwinding.

Alternately, pawl bar 315 may be any other conventional ratchet-locking device associated with any other conventional ratchet-locking and unlocking mechanism, as is generally known to those skilled in that art, utilized with any practical size ratchet gear or gears of any workable ratchet tooth design and configuration, so long as it operates the pawl release and does not interfere with the operation of the device during the restraining process. Although the above described cable tether CERI embodiment does not reach a rigidified connection upon reaching its closure point, it is nonetheless a relatively inexpensive, versatile and practical solution to many law enforcement problems.

Operation—FIGS. 14, 15—Alternate Embodiment

The operation of the alternate cable tether embodiment of FIGS. 14, 15 is generally similar to the operation of the preferred embodiment with the following exceptions: a. rather than having a release button and double-lock mechanism for ratchet control, the alternate embodiment has a vertical ratchet pawl bar 315 release method wherein bar 315 must be side-shifted to operate, and then have its cap 315E screw-twisted to lock the ratchet engagement; b. the embodiment cannot be rigidified as shown; c. carrying is typically done by strapping the two cuffs together and strapping them to the officer's belt rig. Street use of the alternate cable tether embodiment is essentially the same as was given for the preferred embodiment with the following exceptions: a. the grasping method is similar to the one used for chain-linked or hinged handcuffs wherein the control hand wraps around the middle portion, here, central housing 300, and then guides loop restraints 301, 302 to the subject's wrists or ankles; b. the utilized cable length is more restricted, and generally confined to approximately 45.7 mm (18") due to the greater potential for officer control loss with the thinner cable body.

To operate the cable tether embodiment of the present invention in an attempt to cuff a subject behind his back, in terms of a right-handed officer in a typical use situation, the officer grasps central housing 300 palm down with his right hand with his fingers wrapped below the middle length of the housing. He then grasps the subject's left arm or hand with his left hand and applies and locks left loop restraint 301 about the subject's wrist. The officer then typically actuates the ratchet-pin release mechanism by side shifting ratchet pawl bar 315 using his palm edge or a fingertip of his right hand. He does this while he is grasping central housing 300 with his remaining fingers and pulls housing 300 right loop restraint 302 to the right so that cable tether 307 reels out to a desired distance to approach the position of the subject's right wrist. Once the officer releases ratchet pawl bar 315, spring tension from tension block 317 forces ratchet tooth 315A to re-engage, and cable tether spool 308 is no longer able to be unwound.

The officer will then remove his left hand from the subject's restrained left hand, and the officer will move his left hand to grasp the subject's right arm or hand and position right loop restraint 302 to the inside or left of the subject's wrist and then apply left loop restraint 301 to the subject's right wrist. Once the right wrist of the subject is secured by loop restraint 302 it will be tethered to the opposite left restraint 301 along the line of cable tether 307. Therefore, any movement of the subject's arms toward each other will result in the activation of the ratcheting mechanism as retractor spring 313A seeks to rewind tether cable 307 back around spool 308. If the subject does not then willfully comply in placing his wrists together, the officer will then begin to urge the subject's arms or legs together. As he does so the ratchet-locked spool 308 will prevent the subject from pulling away from the opposing restraint, and retractor spring 313A will continue to rewind cable tether 307 back onto spool 308. As the officer continues in small or large increments to bring the opposing arms toward a central position behind the subject's back, cable tether 307 will eventually be ratcheted back against central housing 300 where it will then be held in place by the ratchet mechanism.

If the subject is of a larger than average sizing, the cable tether will not actually reach central housing 300, but the subject will nonetheless be securely held in the restraints. Once the officer determines that a final rest position has been reached for the respective restraints, he will twist-lock ratchet pawl bar cap 315E which will prevent accidental unreeling of spool 308. If the officer is left-handed, or if extenuating circumstances exist, he will use his opposite hands in the above account of operation. The same general operation would apply if ankle restraints were being applied to the subject's legs.

If the particular loop restraint system being used has a key operated, lockably unlockable detent system, once the subject has been brought to the processing room, if he is yet unruly, the officer may choose to only remove the right loop restraint and place the removed restraint in connection with a fixed post retainer or a pre-positioned wall anchor such as a typical processing room eyehook device. The officer can then selectively control the distance which he will permit for radial movement of the subject about the retaining pivot point of connection depending on the tether length provided in the controllably extendible restraint interconnection. Alternately, the officer may release one restraint and place cable tether 307 around an object such as a pole or pipe, and then reattach the second cuff to keep the subject in one location.

Description—FIGS. 16, 17—Alternate Embodiment

As stated at the beginning of the specification, a CERI system is defined as a "tethered restraints" system and comprises any controllably extendible interconnections between restraints or between restraints and anchored mooring points, such as a pipe or a wall hook, wherein the interconnection between the restraints and/or moorings are controllably extendible in relation to each other, and provided with spring-retractable, ratcheted tether connections between any of the restraint or mooring class members, but which may also reach a rigidified closure point between such restraints or moorings.

FIG. 16 is a front view of an alternate embodiment of the CERI invention wherein an integral housing 400 of a CERI system is also a bolt-mounted, pre-positioned wall anchor. FIG. 17 is a top view of the alternate embodiment of FIG. 16. Referring to FIGS. 16, 17, in principle, the embodiment of FIGS. 16, 17 is identical to the embodiment of FIGS. 1–2, or the rigidified embodiment of FIGS. 3–10, with various exceptions. Since the device is not carried by a detainer, the embodiment need not be typically provided with means to make the device foldable, but instead is typically made utilizing a fortified, rigidified, integral housing 400. To fortify the device, for example, the outer casing of integral housing 400 can be provided with thicker metal or composite walls (not shown) to prevent accidental or intentional breakage of the device, and the internal components (not shown) can be made larger and more sturdy. In such an alternate, static embodiment, the right restraint assembly of the previously discussed embodiments would typically be replaced by a suitable means for mounting the alternate embodiment to a predetermined object of choice. For example, as shown in FIGS. 16, 17, a metal or composite mounting plate 401 would be typically utilized for mounting to a concrete or wood stud processing room wall 402. Mounting plate 402 would typically be provided as a thick metal or other material, rectangular or otherwise shaped, mountable plate which would be typically welded or otherwise securely attached to the right (or here, the back portion) of housing 400. Plate 401 would typically be provided with a plurality of holes, for example, a right top hole 401A, a right bottom hole 401B, a left top hole 401C, and a left bottom hole 402D (not shown). Plate 401 would typically be affixed to a concrete wall 402 by utilizing a plurality of wall-anchoring bolts, for example, a right top bolt 403A, a right bottom bolt 403B, and a left top bolt 403C, and a left bottom bolt 403D (not shown).

In FIGS. 16, 17, a left swing-through handcuff assembly 404, similar to that shown and described for FIGS. 3–11 has a rearward (right) portion which is extended to become a beveled insertion member 405. Handcuff assembly 404 has a conventional double strand member 404A with a single strand member 404B, and a conventional hinge pin 404C and conventional ratchet teeth 404D used with a conventional pawl 404E (not shown), and utilizes a conventional locking means accessed through a frontal keyway 404F, and a conventional double lock pin hole 404G.

A belt tether 406 is attached within a vertically and transversely disposed belt slot 405A provided within the forward (right) end of insertion member 405. Slot 405A has a vertically disposed, cylindrical portion 405B. A belt retaining pin 406A around which belt 406 is folded and stitched at stitch line 406B is vertically introduced into slot 405A and slot portion 405B by spreading slot 405A open. Slot 405A also has a metal or other material clamping rivet 405C which is inserted through a side to side aperture 406C (shown filled by rivet 405C) just forward (right) of pin 406A. When rivet 405C is introduced through aperture 406C it punches a hole through folded belt 406. Insertion member 405 with attached belt 406 are received into a suitably sized docking channel 407 (shown in hidden lines) in the left (or forward) end of housing 400. A spool 408 on a vertical axle 408A (both shown in hidden lines) within spool enclosure 400A, equivalent to the one described for FIGS. 3–11 and with an equivalent mechanical ratcheting control assembly (not shown), and with an equivalent retractor spring enclosure 408B containing a retractor spring 408C (both shown in hidden lines) is operated by identical methods utilizing a bottom positioned lock release button 409 (shown in hidden lines) and a right side mounted double-locking button 410 with a forward pin hole access aperture 410A (also shown in hidden lines). The wall plate mounting method would have housing 400 permanently mounted to wall 402 with the tethered cuff end retracted awaiting use for an incoming subject.

Alternately, a CERI wall-mounted embodiment could be made in a fashion similar to a seat belt retractor assembly, and could be provided with an end similar to a seat belt buckle. The buckle assembly would be further provided with a key-releasable catch for a buckle tongue insertion method, or a pin-release method equivalent or similar to that shown and described in the previous alternate embodiment of FIGS. 14, 15. A prisoner could then be tether-buckled to a wall mount using modified restraints, for example, such as handcuffs, loop cuffs or a restraining belt, which had a provided suitable buckle tongue.

Operation—FIGS. 16, 17—Alternate Embodiment

The alternate embodiment of FIGS. 16, 17 may be utilized in a processing room setting whenever a prisoner or detainee requires restraint, but is also required to move some distance about the room to complete the processing, e.g. photographing, fingerprinting, interviewing, or to provide preventative security when the subject is using a rest room, a phone, or eating, etc. In typical use, the detained subject would either: a. remain handcuffed from the original incident and have the swing-through handcuff applied to a wrist or ankle, or applied directly to the incident cuffs; or, b. have the CERI cuff (404) applied to a wrist or ankle and then have the incident cuffs removed.

Prior to or after the subject is tethered to the CERI system, the controlling officer would set the distance for the tether in the way previously described by releasing belt tether 406 utilizing release button 409 and then double-locking the device with double-lock button 410. The subject would have to first be thoroughly searched for removal of any pin-like items which could be used to release the double-lock mechanism. Alternately, the embodiment could be modified with a provided handcuff key-lock double-locking assembly. If a problem arose during processing due to the subject's unruly behavior, he could then be forced back toward housing 400 and be resecured by the ratcheting mechanism.

CONCLUSIONS, RAMIFICATIONS AND SCOPE

There are many possible alternate embodiments of the present invention of a Controllably Extendible Restraint system, or CERI system, each with many possible external and internal differences which still employ the method of the invention. Housing embodiments of varying materials, shapes, contouring, sizes, with varying connection methods with their respective tethered restraints are possible. And as well, the specified elements of the invention could in various alternate embodiments be made of different materials, shapes, contouring, sizes, or the respective elements be placed in differing mechanical configurations. Alternately, various other ratchet and pawl mechanisms of different sizes, shapes and configurations could be utilized within the invention. For example, alternately a graspable housing could be otherwise configured in relation to a fixed restraint and a tethered restraint so that both restraints were respectively at the top ends of a wide-mouthed V-formation and wherein a winding spool, ratchet assembly, and control method were placed in the lower form of the V-shaped housing. Or for example, alternately, a pawl bar in a ratchet assembly could be operated by an externally actuated direct pull or levering rod or bar which protruded through the top, bottom or sides of the embodiment, or could be operated by a button-depressible, tilt-lever mechanism.

Alternately, the tether-docking end of a housing need not be a vertical channel, but could be a receiving spring catch assembly for a matable protruding pin assembly at the forward end of an alternate tethered restraint member. Or alternately, an insertion member could have a cone-shaped head for entering a funnel-shaped recess in a right arm, with or without locking-pin mechanisms added in. Or, alternately, a spool may be elsewhere positioned in the assembly configuration, for example, to the rear of the device or to the side, rather than in the middle front. Or alternately, a CERI system may be provided with two or more ratcheted spools and two or more cables or belts, both with associated release mechanisms. Or alternately, the device could have belt or cable rollers or a Teflon-like slide-guide at an end of a housing where the belt or cable reels out of the housing to allow for an easier extraction and retraction of a belt or cable tethered restraint. And alternately, an embodiment of the device could have a wedge-shaped or otherwise shaped funneling extension just forward of the belt or cable spool to better control the release and rewind of a tether.

Alternately, a ratchet lock-open switching assembly could be provided for the invention allowing a connection between wrists or ankles to be connected between two wrist or ankle cuffs that allows a detainee respectively to use his hands or walk at a predetermined distance while cuffed. The reel would unwind the strap as the detainee's respective arms or legs are spread apart, and wind-in the strap as the respective arms or legs were brought together. A similar wall-mounted device could also be utilized to set a predetermined distance for a tether restrained prisoner to move about a fixed pre-positioned point.

Alternately, a CERI device could be made in two separate housings with only a tether cable or belt connecting the two separate housings. The two housings would typically have a protruding end in one housing that mated with an equivalently configured recessed area in the opposing end of the opposite housing so that the opposing housings could be made integral and rigid when interconnected. Such an alternate CERI device would be foldable at its tether for slinging over a belt loop or be otherwise carried in a folded manner.

Alternately, various mock model embodiments of any CERI system embodiment may be manufactured for training use purposes. Such mock model embodiments would duplicate the principles of the actual embodiments and would typically be made of lighter weight materials such as plastic.

Alternately, a CERI system could have various types of restraints provided with attachably-detachable seat belt-like, single or multiple slotted buckle plates for insertion into either a fixed position end or an insertion module end of a CERI device. The buckled restraints would respectively be provided with a spring catch mechanism for a buckle plate slot, and be further provided with a keying mechanism, typically a handcuff keying mechanism, for locking and unlocking the restraint insertion buckle from the ends of the device. And alternately, the above described configuration could be reversed and the attachably-detachable restraints could have a key-lockable insertion-buckle receiver and the right arm have a single or multiple slotted buckle plates.

Alternately, an embodiment could be provided at the respective outward facing ends of a right arm and a left arm with lockably foldable hinges for respective attached end restraints to decrease the overall length of the folded unit. Alternately, a CERI system device could be provided with multiple end restraints to enable an officer to tether two or more subjects to each other or to a fixed object such as a pre-positioned wall anchor.

Alternately, an embodiment could be made with lockably unlockable, attachably-detachable release systems for temporary attachment to individual restraints, for example, such as would fit around a conventional interconnecting chain for handcuffs.

Alternately, a foldable embodiment of the invention may have any workable type of pivoting configuration connection utilized between its opposing arms. Alternately, either or both arms can be made to rotate about a common pivoting hinge point, or on two separate hinge pivots.

Alternately, different configurations of releasably-lockable mechanisms can be utilized to integrate and rigidify a folding embodiment, for example, in an upper and lower spool cover capturing embodiment, spring-biased locking bars or pins would be affixed to one arm which would be insertable into apertures within the rotatable spool covers of the opposing arm.

Alternately, an externally-levered ratchet assembly could be provided for an embodiment by providing a fixed, directly connective rod or bar or similar lever which may be actuated from the outside of the device and which would actuate the internal mechanism of the ratchet assembly to gain mechanical advantage. Equivalently, an alternate embodiment could have an attachably-detachable lever which is utilized by insertion into an aperture which enables a connection with a ratchet assembly to lever its ratchet.

Alternately, in a more advanced electronically operated embodiment, a remote electronic key locking and unlocking device could be provided to actuate one or more locking mechanisms provided within the invention. Or alternately, an embodiment could be provided with electrified accessories, for example, a motor-driven rewinding ratchet gears, with provided appropriate circuitry and switchwork. Or alternately, an embodiment could be provided with a flashlight and/or recharging unit with a rechargeable battery. Alternately, a CERI embodiment could be provided with an internal Ground Position Satellite locator system (GPS) to assist in the location of an escaped cuffed prisoner.

Alternately, any embodiment of the invention could have any color scheme from a conventional nickel or satin finish to a darker embodiment for undercover use, and as well have any surface texture from smooth to dot stippled or ridged. Alternately, an embodiment could be provided with a high friction plastic casing with provided openings for accessing various restraint control portions such as the keyway or double-lock aperture of conventional handcuffs, and as well be provided with ergonomic finger grips with arcurate sections and finger indentations.

Alternately, a CERI cable or belt tether could be ruler marked with color coding or other indicia to reflect metric and/or English measures and be utilized as way of determining the distance which the tether has been extracted from the device, or could be utilized as a ruler method.

Alternately, a simplistic CERI system embodiment could be made which comprised two or more restraints, each respectively connected to an extended cord, which two cords would then commonly pass through a slidably movable cinching block. The cords may or may not terminate in a common tying point or other locking fastener on the side of the cinching block opposite the restraints. Either the two cords or a fastener could then be held with one hand for leverage while the cinching block was slid toward the restraints by the other hand. Once the separate cuffs are applied, the user could hold the two cords or fastener and then slide the cinching block toward the restraints until they were forced together.

Controllably extendible restraint interconnections, or CERI systems represent a novel approach to the arrest procedure. With a compliant subject, the various embodiments must be able to do whatever other cuffs will do. With an unruly subject, the various CERI embodiments now represent a new way of thinking about tactical situations where it is kept in mind that extending the distance between restraints is now a possible option. Using a CERI system means learning a new tactical arrest method that is easier, safer and more effective. New techniques of cuff application and removal will be required to be taught which means more costs for mock devices for training and actual devices for street use. However, the reduced liability during difficult takedown injuries for both officers and offenders should offset these costs to make them appear both reasonable and wise. Assuming the respective CERI embodiments are durably made in such a manner as to not fail or break during a difficult takedown utilization, they will represent state of the art survival equipment for law enforcement officials.

ESSENCE OF THE INVENTION

From all of the drawings, descriptions and accounts of operation of the various implementation embodiments of the present invention cited above, the essence of the invention as a controllably extendible restraint interconnection system is that it has:

1. a graspable housing or the equivalent thereof,
2. a plurality of restraint members;
3. a tether winding apparatus with a minimum of one connected ratchet gear;
4. a cable, cord, or belt tether connected at one end to the tether winding apparatus, and at the other end to a first restraint member;
5. a second restraint member suitably attached to the graspable housing or its equivalent;
6. a ratchet-locking assembly connective with the winding apparatus to forcibly stop the unwinding of the tether therefrom;
7. a manually-actuable mechanism for controllably disengaging the ratchet locking assembly, whereby:

a. when the second restraint member connected to the tether connected to the winding apparatus is outwardly drawn; and
b. when the ratcheted locking assembly in the winding apparatus to stop the unwinding of the tether therefrom is engaged,
c. the winding apparatus will only be enabled to rewind the tether in ratcheted increments, and thereby draw the first restraint member and the second restraint member together whenever there is no resisting force which will re-engage the locking assembly.

What is new and significant about the controllably extendible restraint interconnections invention is that the method of the various embodiments:

a. permits a user to controllably extend opposing restraints, or restraints from pre-positioned anchors, and then to controllably ratchet the opposing restraints or restraints and anchor together with the urging of a tether rewinding mechanism;
b. permits a user to controllably, lockably unlockably distance a tether between two or more restraints or between restraints and a pre-positioned anchor, so that various uses may made of the extended tether length.

Therefore, if a device bearing the specific combination of manufacturing parameters as just specified were made and referred to by others as, for example, a "ratcheted retractor connection device for restraints," or the like, each would be, by direct reference or implication, implementation devices of the method of the present invention.

The several embodiments described above are only illustrative examples of the present invention and it should not be construed that the present invention is limited to those particular embodiments. Various changes and modifications in alternate embodiments of the present invention, as noted above or as may be determined in the future, may be effected by one skilled in the art to which the invention relates without departing from the spirit or scope of the present invention as defined in the appended claims.

We claim:

1. A controllably extendible restraint interconnection device for use by a detainer for securing one or more appendages of a human detainee comprising:

a. a housing means graspable by said detainer, and
b. a tethering means connective at a first end with a rotatable tether winding retracting means, with c. said rotatable tether winding retracting means also further connective with a ratcheting means having a ratchet locking means which acts cooperatively with said ratcheting means, and d. said tethering means connective at a second end with a first human appendage restraint means at a first end of said housing means, and e. a second human appendage restraint means connective with a second end of said housing means, and f. a manually actuable means for controllably disengaging said ratchet locking means from said ratcheting means to permit said tethering means to be manually extracted, whereby, whenever said ratchet locking means is controllably disengaged from said ratcheting means by said manually actuable means, said tethering means may be manually urged to extract from said rotatable tether winding retracting means, with said extraction thus urging said connective tether winding retracting means into a higher state of retraction urging tension, and whereby whenever said ratchet locking means is not controllably disengaged by said manually actuable means, said tethering means will be urged by said winding retracting means to forcibly retract, and will be forcibly stopped from being extracted by said ratcheting means, thereby unidirectionally urging said connective first human appendage restraint means and said connective second human appendage restraint means toward one another in ratcheted increments, and forcibly stopping said tethering means from being extracted from said tether winding retracting means whenever there is a resisting force.

2. The controllably extendible restraint interconnection device of claim 1 wherein said second connective restraint means is a device for restraining movement from a prepositioned anchoring means.

3. The controllably extendible restraint interconnection device of claim 1 wherein said graspable housing means is a plurality of housings and includes a folding means and a rigidifying means to form an integral housing.

4. The controllably extendible restraint interconnection device of claim 1 further including a lockingly unlockable restraint retaining means for attachably detachable restraint members.

5. The controllably extendible restraint interconnection device of claim 1 further including a double locking means for said ratchet locking means.

6. The controllably extendible restraint interconnection device of claim 5 further including an extended pin handcuff key.

7. The controllably extendible restraint interconnection device of claim 1 wherein said manually actuable means for disengaging said ratchet locking means from said ratcheting means further includes a push bar means connective with a return spring means for connectively mechanically disengaging and re-engaging said ratchet locking means.

8. The controllably extendible restraint interconnection device of claim 1 wherein said tethering means is selected from the group consisting of belts, and cords, and cables.

9. The controllably extendible restraint interconnection device of claim 1 further including a carrying means suitable for carrying said controllably extendible restraint interconnection device upon a belt and structured to suit the specific dimensions of said controllably extendible restraint interconnection device.

10. The controllably extendible restraint interconnection device of claim 1 wherein said device has said housing means and said first and second human appendage restraint means made from lightweight plastic materials for utilization as a mock device for training law enforcement officials in the proper uses of said controllably extendible restraint interconnection device for securing said one or more appendages of a human detainee.

* * * * *